US011064763B1

(12) United States Patent
Longbottom et al.

(10) Patent No.: US 11,064,763 B1
(45) Date of Patent: Jul. 20, 2021

(54) CONTOURED THIN SOLES

(71) Applicant: ADIDAS AG, Herzogenaurach (DE)

(72) Inventors: Mark Longbottom, Vista, CA (US); Yoshinori Kobayashi, Vista, CA (US); Kelly Kikuta, Long Beach, CA (US); Mason Dennison, Carlsbad, CA (US)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 15/787,617

(22) Filed: Oct. 18, 2017

(51) Int. Cl.

| | |
|---|---|
| ***A43B 13/22*** | (2006.01) |
| ***A43B 13/14*** | (2006.01) |
| ***A43B 5/00*** | (2006.01) |
| ***A43B 13/18*** | (2006.01) |
| *A43C 15/16* | (2006.01) |

(52) U.S. Cl.
CPC ..... *A43B 13/141* (2013.01); *A43B 5/001* (2013.01); *A43B 13/187* (2013.01); *A43B 13/223* (2013.01); *A43C 15/165* (2013.01)

(58) Field of Classification Search
CPC ..... A43B 13/141; A43B 13/223; A43B 7/146; A43B 7/1425; A43B 7/1445; A43B 7/1435; A43B 7/145
USPC ..... 36/28, 29, 140, 102
See application file for complete search history.

(56) References Cited

U.S. PATENT DOCUMENTS 2,198,338 A * 4/1940 Greider ..... A43B 13/12 36/104
2,367,808 A * 1/1945 Starner ..... A43B 13/37 36/19.5
D201,952 S * 8/1965 Johns ..... 36/59 C
3,595,244 A * 7/1971 Kugler ..... A43B 13/14 36/141
4,075,772 A * 2/1978 Sicurella ..... A43B 7/141 36/11.5
4,133,118 A * 1/1979 Khalsa ..... A43B 7/14 36/29
D259,595 S * 6/1981 Famolare, Jr. ..... D2/955
4,281,467 A * 8/1981 Anderie ..... A43B 13/223 36/32 R
4,364,188 A * 12/1982 Turner ..... A43B 5/06 36/129
4,398,357 A * 8/1983 Batra ..... A43B 13/16 36/129
4,498,251 A * 2/1985 Shin ..... A43B 5/06 36/30 R
D281,641 S * 12/1985 Shiki ..... D2/953
D285,985 S * 10/1986 Tong ..... 36/32 R
4,658,514 A * 4/1987 Shin ..... A43B 5/06 36/30 R
4,667,423 A * 5/1987 Autry ..... A43B 13/12 36/102
4,694,831 A * 9/1987 Seltzer ..... A43B 7/00 15/227
4,759,136 A * 7/1988 Stewart ..... A43B 7/14 36/114

(Continued)

*Primary Examiner* — Ted Kavanaugh
(74) *Attorney, Agent, or Firm* — Sterne, Kessler, Goldstein & Fox P.L.L.C.

(57) ABSTRACT

A sole of a shoe includes: a rear portion; and a forward portion connected with the rear portion, the forward portion being thinner than the rear portion, the forward portion comprising a plurality of ribs that are patterned and contoured to provide different height, rigidity and flexibility characteristics at different areas of the forward portion.

25 Claims, 14 Drawing Sheets

(56) References Cited

U.S. PATENT DOCUMENTS 4,779,361 A * 10/1988 Kinsaul ..... A43B 13/141 36/102
RE33,066 E * 9/1989 Stubblefield ..... A43B 7/144 36/83
D303,871 S * 10/1989 Driscoll ..... D2/955
5,322,056 A * 6/1994 Menghi ..... A43B 7/141 36/11.5
5,400,526 A * 3/1995 Sessa ..... A43B 1/0045 36/141
5,551,173 A * 9/1996 Chambers ..... A43B 7/146 36/141
D384,796 S * 10/1997 Smith, III ..... D2/954
D388,350 S * 12/1997 Smith ..... D2/953
D389,993 S * 2/1998 Ryan ..... D2/953
D413,011 S * 8/1999 Yokoyama ..... D2/947
5,946,824 A * 9/1999 Tighe ..... A43B 13/181 36/25 R
6,101,746 A * 8/2000 Evans ..... A43B 3/0042 36/128
6,385,866 B1 * 5/2002 Sotter ..... A43B 13/223 36/59 C
D460,247 S * 7/2002 Liu ..... D2/951
D461,295 S * 8/2002 Pollastrelli ..... D2/951
6,564,476 B1 * 5/2003 Hernandez ..... A43B 1/0009 36/103
6,625,902 B2 * 9/2003 Yamamoto ..... A43B 7/08 36/102
6,691,432 B2 * 2/2004 Masseron ..... A43B 13/12 36/141
D504,555 S * 5/2005 Urie ..... D2/954
D606,292 S * 12/2009 Ong ..... D2/947
D743,154 S * 11/2015 Nethongkome ..... D2/951
D804,158 S * 12/2017 Nykreim ..... D2/955
D837,498 S * 1/2019 Winfield ..... D2/955
2003/0033730 A1 * 2/2003 Burke ..... A43B 7/142 36/25 R
2005/0060914 A1 * 3/2005 Fuerst ..... A43B 7/141 36/102
2006/0016100 A1 * 1/2006 Riha ..... A43B 13/141 36/59 R
2009/0038179 A1 * 2/2009 Chen ..... A43B 7/146 36/41
2013/0291409 A1 * 11/2013 Reinhardt ..... A43B 13/04 36/30 R

* cited by examiner

CONTOURED THIN SOLES

FIELD OF THE INVENTION

The invention is generally related to shoes used during sporting activities and, more particularly, to shoes having contoured thin soles for optimizing performance and other characteristics of the shoe based on anticipated movements of the feet of an athlete during a particular sporting activity (e.g., golf).

BACKGROUND OF THE INVENTION

Many sporting activities today require repeatedly performing actions in a predetermined manner, which require different movements of a player's feet while performing the sporting activity. For example, in golf, the golfer's footwork during the swing is complex and differs during different golf motions. In general, for most golf shots the golfer's weight is initially loaded 50/50 on each foot and the golfer's weight is typically distributed evenly across the bottom surface area of each foot. During the backswing, a majority of the golfer's weight typically shifts to the outside (lateral side) of the golfer's back foot while the front foot maintains some weight for balance. The backswing applies forces tending to spin or pivot the back forefoot outwardly and the back heel inwardly, which must be resisted by the back foot's contact with the ground to keep the golfer's back foot stable.

During the downswing of the club, the golfer's weight begins to shift and by the time the golf ball is struck, the golfer's weight is again evenly distributed between the rear and front feet, or has started to shift more to the front foot. At the finish position of the swing, most of the golfer's weight is on the front foot with more weight on the outside (lateral side) of the front foot than the inside (medial side), and the golfer's heel and shoe outsole of the back foot are elevated above the ground and face rearwardly. In a proper swing, only the toe portion of the golfer's rear foot remains in contact with the ground at the finish. In the finish position, the heel and most of the outsole of the golfer's rear shoe are off of the ground, with only the toe portion contacting the ground for balance.

As discussed above, the golfer's feet make complex movements during a golf swing to keep the golfer balanced while generating torque and club head speed to strike the golf ball. During various stages of the golf swing, different forces, pressures, and stresses are exerted on the feet as the feet pivot and move, which require each shoe to perform and react in a flexible manner. Similar circumstances exist during other sports such as baseball (e.g., during a batter's swing) and track & field (e.g., during start and running in a counter-clockwise direction on a track). However, conventional shoes used during sporting activities may have soles that are generally thicker (e.g., for more cushioning from the ground while running) and without specific contouring for stationary flexibility (e.g., while not running) to optimize their performance during a specific sporting activity.

Additionally, in conventional golf shoes, the sole moves as a rigid, non-flexible unit such that when the heel lifts or the foot tilts to the side, a majority of the sole lifts off the ground and loses traction, leaving only the toe or a side edge in contact with the ground for traction. Furthermore, in conventional golf shoes, the sole lacks flexibility to promote smooth energy transfer between the ground and the golfer's feet during the golf swing. The relatively rigid soles of conventional golf shoes can also be uncomfortable to a golfer compared to other types of athletic shoes.

SUMMARY OF THE INVENTION

The invention addresses the above deficiencies of conventional shoes by providing shoes with contoured thin soles to optimize performance during a particular sporting activity. Although various exemplary embodiments of the invention are described herein in the context of golf, one of ordinary skill in the art will appreciate that various features and concepts discussed herein can be applied to shoes used during any sporting activity that repeatedly requires different movements and actions to flex and pivot the feet of a player.

Additionally, exemplary contoured thin soles may be described herein for a right, or back sole (that is part of a right, or back shoe, as will be discussed further below). One of ordinary skill in the art will recognize that features of the exemplary contoured thin soles described for the right, or back shoe may also be applicable for a contoured thin sole of a mirrored left, or front shoe (and vice-versa). Accordingly, features described for one sole may be applied to the mirrored opposite sole, in accordance with various embodiments.

In one embodiment of the invention, a sole of a shoe includes: a rear portion; and a forward portion connected with the rear portion, the forward portion being thinner than the rear portion, the forward portion comprising a plurality of ribs that are patterned and contoured to provide different height, rigidity and flexibility characteristics at different areas of the forward portion.

In another embodiment, a shoe includes: an upper; and a sole attached to the upper, the sole comprising: a rear portion, the rear portion comprising a cushioning structure; and a forward portion connected with the rear portion, the forward portion being thinner than the rear portion, the forward portion comprising a plurality of ribs that are patterned and contoured to provide different height, rigidity and flexibility characteristics at different areas of the forward portion.

In another embodiment, a golf shoe includes: an upper; and a sole attached to the upper, the sole comprising: a rear portion, the rear portion comprising a cushioning structure; and a forward portion connected with the rear portion, the forward portion being thinner than the rear portion, the forward portion comprising a plurality of ribs separated from one another by spaces that define at least one distinct area corresponding to where at least one portion of a wearer's foot will be closest to the ground during a sporting activity, wherein the at least one distinct area comprises a section selected from the group consisting of a big toe section, a lateral pad section, and a big toe pad section.

Further features and advantages of the present invention, as well as the structure and operation of various embodiments of the present invention, are described in detail below with reference to the accompanying drawings.

BRIEF DESCRIPTION OF THE DRAWINGS

In the following description of exemplary embodiments, reference is made to the following Figures which form a part hereof, and in which it is shown by way of illustration specific embodiments in which the invention may be made and practiced. It is to be understood that other embodiments may be utilized, and design and/or structural changes may be made, without departing from the scope of the invention. The Figures are provided for purposes of illustration only and merely depict exemplary embodiments of the invention to facilitate the reader's understanding of the invention and should not be considered limiting of the breadth, scope, or applicability of the invention. It should be noted that for clarity and ease of illustration these drawings are not necessarily drawn to scale.

DETAILED DESCRIPTION OF EXEMPLARY EMBODIMENTS OF THE INVENTION

Figure 1A:
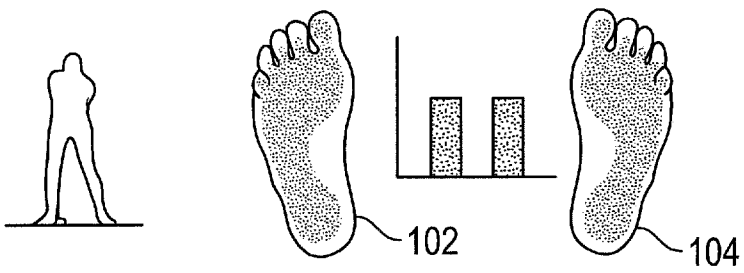
FIGS. 1A-1D illustrate exemplary top-down through-views of vertical force intensities as the front and back feet of a golfer pivot during various stages of the golf swing.

In the following description of exemplary embodiments, reference is made to the accompanying drawings which form a part hereof, and in which it is shown by way of illustration of specific embodiments in which the invention may be practiced. It is to be understood that other embodiments may be utilized and structural changes may be made without departing from the scope of the invention. Although various embodiments and features of the invention are described below in the context of golf shoes, it will be apparent to those of ordinary skill in the art that various features and advantages of the invention can be applied to shoes used during other types of sporting activities that require or promote flexible and/or pivoting foot actions.

Systems and methods in accordance with various embodiments describe contoured thin soles (of shoes) structured for enhancement of shoe performance during sporting activities. In accordance with some embodiments, a contoured thin sole may include an outsole with a bottom portion (bottom outsole) configured to contact the ground and a top portion (top outsole) on which a foot of a wearer may rest. The top outsole may support a thicker padded rear portion along the top of the contoured thin sole that transitions into a thinner, flexible forward portion along the top of the contoured thin sole. The thicker, padded rear portion of the contoured thin sole, supported by the top outsole, may also be referred to as the midsole of the contoured thin sole. The rear portion and the forward portion may be delineated along the top of the contoured thin sole by an arch of a foot. For example, the forward portion may include the forward part of the contoured thin sole (inclusive of part of the top outsole) and end where the arch of the foot begins. The rear portion may include the remainder of the top of the contoured thin sole behind the forward portion. The contoured thin sole may also feature a general transition zone between the two portions, where the thickness of the contoured thin sole gradually transitions from where the thicker rear portion meets the thinner forward portion. In some embodiments, the thicker rear portion and the thinner forward portion may be made from different materials. As used herein, "thickness" refers to the thickness along a vertical axis (e.g., upward or downward) when a contoured thin sole rests on a horizontal surface.

Various ribs may be patterned, or contoured, across the forward portion, in accordance with various embodiments. In some embodiments, the ribs extend between the lateral and medial sides of the sole, as described in further detail below. This ribbed contouring provides numerous spaces between the ribs that allow the ribs to be deformed as the contoured thin sole (and, generally, the shoe) bends and flexes during sporting activities (e.g., pivoting and bending during a golf swing), accordingly enhancing flexibility of the thin sole (e.g., bending along a horizontal axis extending between lateral and medial sides of the sole). As also discussed in further detail below, depending on the size, shape and direction of the ribs as well as the longitudinal and lateral spacing between adjacent ribs, the plurality of ribs can provide a desired amount of stiffness and rigidity to different areas of the sole, while also providing a desired flexibility. Thus, the patterned and contoured ribs can optimize flexibility and rigidity at different areas of the sole to provide desired performance, comfort and feel characteristics.

As mentioned above, the ribbed contouring may include various rib thicknesses (i.e., heights), widths, lengths and spacing between ribs, that may put certain areas of the foot (e.g., areas of the foot that bear greater force during a golf swing, for example) closer to the ground than other areas of the foot. As will be discussed below, such areas of the foot may include a big toe (e.g., hallux), a big toe pad (e.g., a portion of the foot bottom at the transition of the big toe metatarsal bone and the phalange of the big toe), a lateral pad (e.g., a portion of the foot bottom at the transition between the metatarsal bones and the phalange bones of toes other than the big toe), and a general pad (the portion of the foot bottom that includes the big toe pad and the lateral pad). The foot may have concentration points when pivoting or arching the foot during an activity such as a golf swing. Accordingly, the ribs may be thinner and/or more spaced apart and/or less dense within a section of the contoured thin sole that the big toe, lateral pad, big toe pad, or general pad may rest upon, in accordance with some embodiments.

Additionally, the ribbed contouring may include a patterning of ribs that are disconnected and/or offset from each other. This patterning may conform to a heat map focused around the concentration points, or the thinner parts of the forward portion, with the ribs becoming denser, larger, and/or thicker with greater distance away from the concentration points. Furthermore, the patterning may include patterned openings between the ribs that may form concentric ellipses, or arcs, of openings between the ribs that radiate from (i.e., form larger concentric ellipses or arcs) with distance away from the center of the concentration points. Also, the ribs may be offset (i.e., not extending in parallel across the lateral and medial sides) for greater spacing between ribs, to afford more flexibility and compression (such as for enhanced horizontal fold flexibility) and lower center of gravity control at the concentration points (e.g., pivot points) of the foot. Additionally, in addition to being parallel in some areas, the ribs in other areas may be arced (i.e., curved), but may still extend between the lateral and medial sides, to generally follow a longitudinal central axis (along the center of the contoured thin sole from the most forward part of the contoured thin sole to the most rear part of the contoured thin sole) that curves along with the asymmetrical curves of a contoured thin sole. In certain embodiments, the ribs (that extend horizontally) may include longitudinal connections that connect horizontal ribs longitudinally (e.g., not horizontally) to make the horizontal ribs more rigid, such as in areas of the contoured thin sole closer to the transition between the flexible forward portion and the more rigid, thicker, padded, less flexible rear portion of the contoured thin sole.

Also, the bottom outsole may include an arrangement of macro spikes (i.e., protrusions) and micro spikes (i.e., protrusions smaller than the macro spikes) contoured based on force intensities at the sole. The macro spikes may be evenly, or symmetrically, distributed to provide even support for the bottom outsole on ground that the bottom outsole may rest upon. Also, the micro spikes may be distributed along pressure regions of the bottom outsole with greater force intensities than other regions of the bottom outsole for additional control and support (such as in situations when micro spikes may contact ground that the macro spikes may sink through), as will be discussed further below.

FIGS. 1A-1D illustrate vertical force intensity distributions on the left and right feet of a right-handed golfer during various exemplary stages of the golf swing. These figures also illustrate, generally, how the front and back feet move during the golf swing, which results in the different vertical forces shown for each foot. Bar graphs presented between the left and right feet in each figure graphically represent the relative force distribution on each foot during different stages of the golf swing. Additionally, the density of shading on each foot represents, generally, typical vertical force intensities exerted on different portions of each foot during different stages of the golf swing.

Figure 1B:
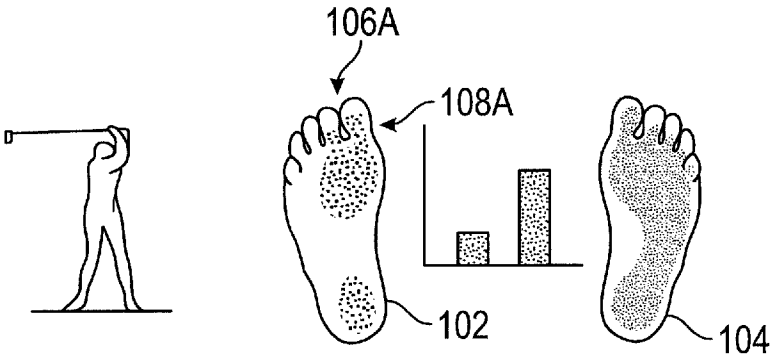

As shown in FIG. 1A, at the beginning of the golf swing when the golfer is addressing the golf ball, the golfer's weight is typically evenly distributed on both front (left) 102 and back (right) feet 104, which results in an even distribution of vertical forces applied across the majority of the bottom surface area of each foot. As shown in FIG. 1B, when the golfer has reached the top of the backswing, the majority of his weight, and hence the majority of vertical forces, shifts to his back foot 104. Also, the majority of vertical force at the front foot 104 is at the big toe 106A and at the big toe pad 108A portions of the front foot 102, each of which may serve as concentration points for pivoting or flexibility.

Figure 1C:
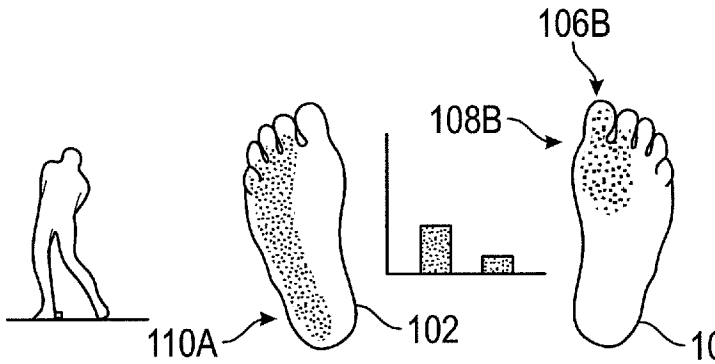

As the golfer begins his downswing, his weight will start shifting again to his front foot 102 and when the club head impacts the golf ball, the majority of his weight, and hence vertical forces, shifts to the front foot 102, as shown in FIG. 1C. As illustrated in FIG. 1C, the vertical force may be concentrated around the lateral edge 110A of the front foot 102 and around the big toe 106B and big toe pad 108B of the back foot 104, each of which may serve as concentration points for pivoting or flexibility.

Figure 1D:
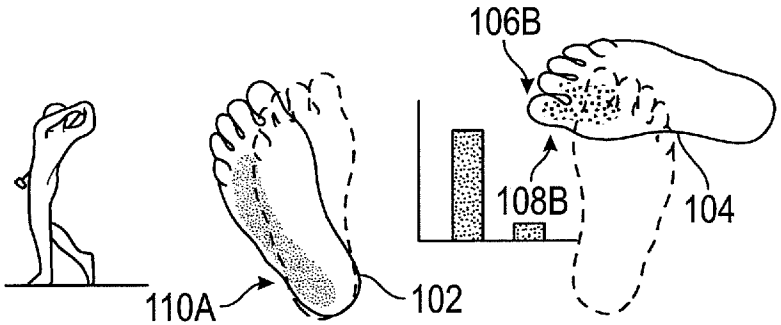

At the end of the swing approximately 80% or more of the golfer's weight has shifted to the lateral edge 110A of his front foot 102 with only a small portion of his weight supported by the big toe 106B and big toe pad 108B of his rear foot 104, as shown in FIG. 1D. Also, as shown in FIG. 1D, the concentration of force illustrated in FIG. 1C at concentration points such as the lateral edge 110A of the front foot 102 and around the big toe 106B and big toe pad 108B of the back foot 104 facilitate a pivot of the front foot 102 and the back foot 104. The pivot is illustrated with the positions of FIG. 1C in dotted lines overlaying the positions of FIG. 1D.

In addition to vertical forces discussed above, different directional horizontal forces act upon the golfer's front 102 and back feet 104 during different stages of the golf swing and the transitions between these stages. FIGS. 2A-2D illustrate typical directional horizontal forces that are exerted on a golfer's front and back feet during different exemplary stages of the golf swing, where the arrow heads indicate the direction of the horizontal force and the shading intensities of the arrow heads indicate the relative strength of such horizontal forces (the darker the shading the stronger the force).

Figure 2A:
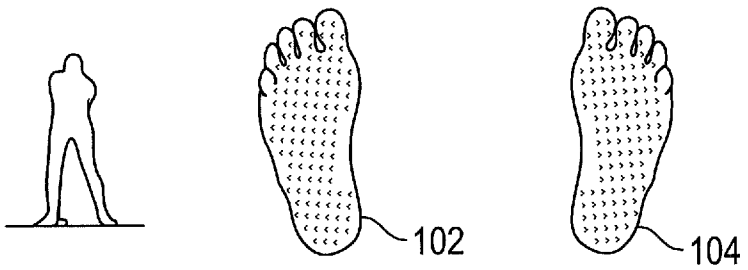
FIGS. 2A-2D illustrate exemplary top-down through-views of directional horizontal force intensities exerted on the front and back feet of a golfer during various stages of the golf swing.
Figure 2B:
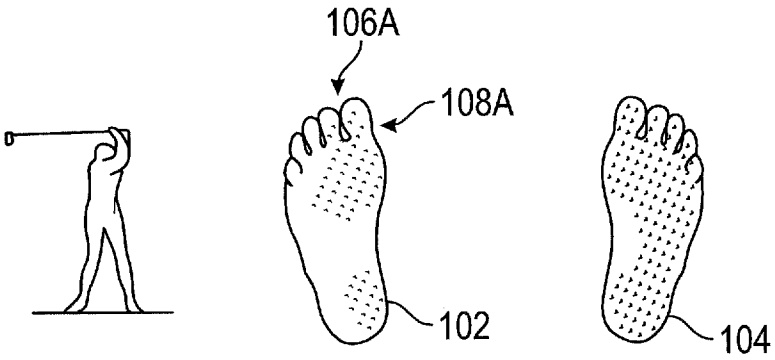

As shown in FIG. 2A, at the beginning of the swing when the golfer is addressing the golf ball, his weight is typically evenly distributed on both feet 102, 104 and the directional horizontal forces exerted on both feet 102, 104 are generally in the lateral (outward) direction on both feet 104, 104. As shown in FIG. 2B, when the golfer has reached the top of the backswing, the majority of his weight shifts to his back (right) foot 104 and the directional horizontal forces on the rear foot 104 are in a lateral and slightly rearward (i.e., downward angle on the page) direction with respect to the back foot 104. Also, as shown in FIG. 2B, the horizontal forces at the front foot 102 are concentrated at concentration points such as the big toe 106A and at the big toe pad 108A portions of the front foot 102.

Figure 2C:
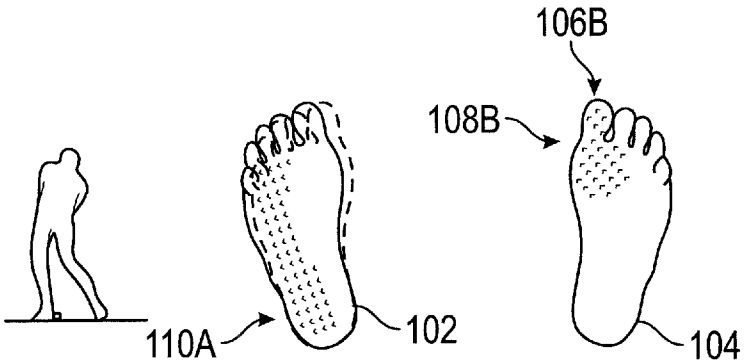

As the golfer begins his downswing, his weight will start shifting again back to his front foot 102 and when the club head impacts the golf ball, the majority of his weight shifts to the front foot 102 and the directional forces on the front foot 102 are in a lateral and slightly rearward direction with respect to the front foot 104, as shown in FIG. 2C. As illustrated in FIG. 2C, the horizontal force may be concentrated around concentration points such as the lateral edge 110A of the front foot 102 and around the big toe 106B and big toe pad 108B of the back foot 104.

Figure 2D:
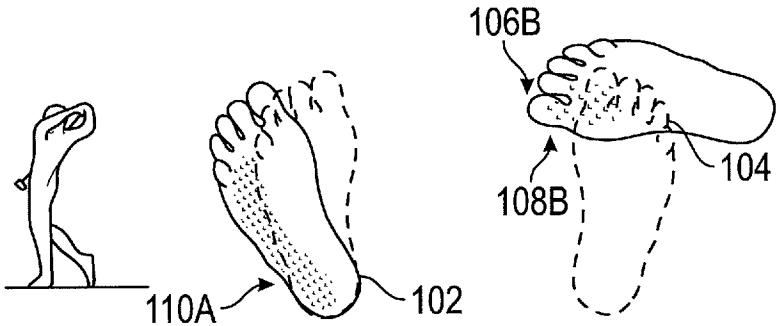

At the end of the swing approximately 80% or more of the golfer's weight has shifted to the lateral edge 110A of his front foot 102 with only a small portion of his weight supported by concentration points such as the big toe 106B and the big toe pad 108B of his rear foot 104. At this point in the swing, only a relatively small amount of directional horizontal forces in a lateral and rearward direction are exerted on the front foot 102 (at the lateral edge 110A), as shown in FIG. 2D. Also, as shown in FIG. 2D, the concentration of force illustrated in FIG. 2C at concentration points such as the lateral edge 110A of the front foot 102 and around the big toe 106B and big toe pad 108B of the back foot 104 facilitate a pivot of the front foot 102 and the back foot 104. The pivot is illustrated with the positions of FIG. 1C in dotted lines overlaying the positions of FIG. 1D.

Figure 3A:
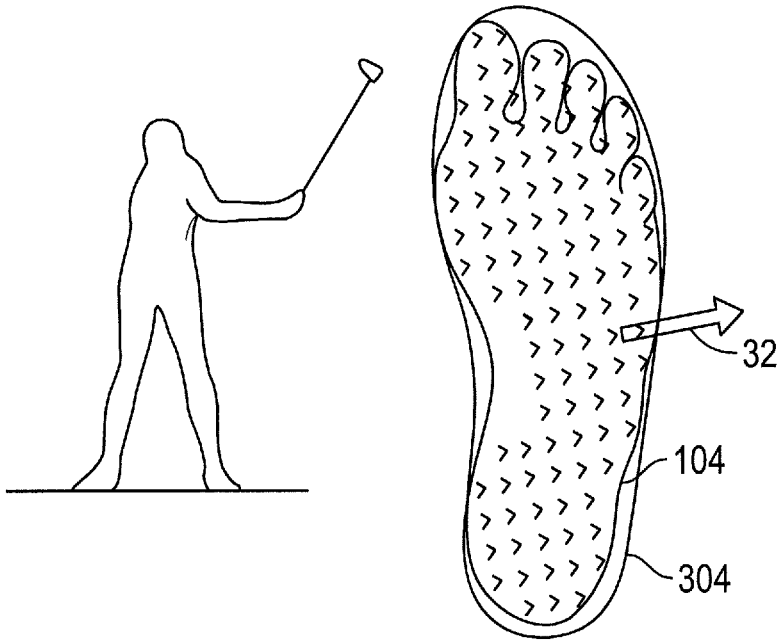
FIGS. 3A and 3B illustrate exemplary top-down through-views of directional horizontal force intensities exerted on a golfer's back foot during two intermediates stages of the golfer's backward swing, respectively.
Figure 3B:
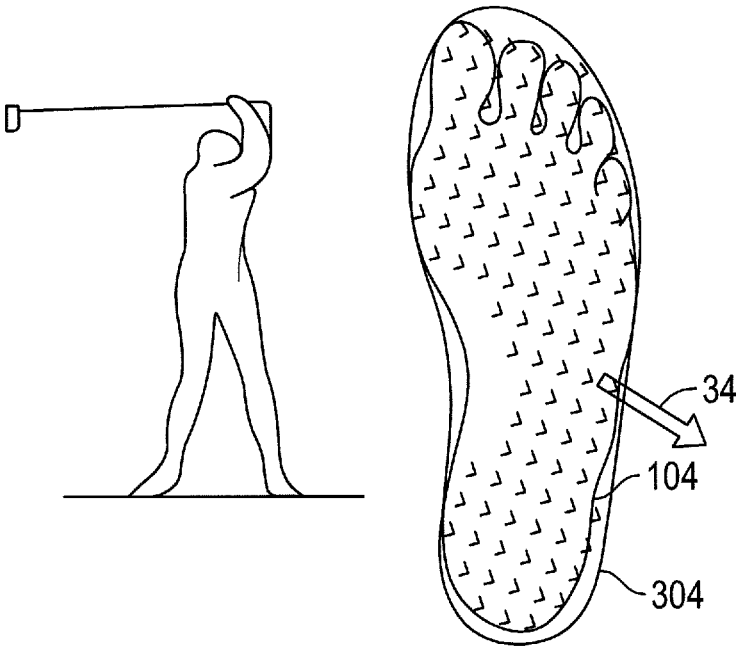

FIGS. 3A and 3B illustrate different directional horizontal forces exerted on the back foot 104 within an outline of a sole 304 at an intermediate transition stage during the back swing and the top of the back swing, respectively. As these figures illustrate, the direction of the horizontal forces changes from a lateral, slightly forward direction as indicated by arrow 32 in FIG. 3A, to a lateral, slightly rearward direction as indicated by arrow 34 in FIG. 3B.

In one embodiment of the invention, described in further detail below, the contoured ribs at the top of the outsole (e.g., at the forward portion) and spikes (macro spikes and micro spikes) at the bottom of the outsole (bottom outsole) of the contoured thin sole facilitates better foot control, especially at concentration points for pivoting and compensating for the directional forces exerted during the back swing, to optimize performance during the back swing.

Figure 4A:
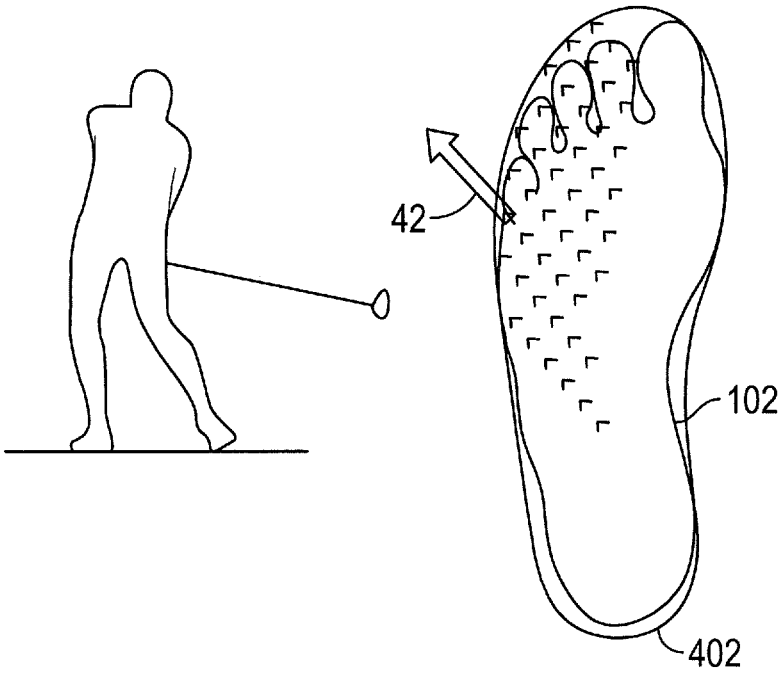
FIGS. 4A and 4B illustrate exemplary top-down through-views of directional horizontal force intensities exerted on a golfer's front foot during two intermediates stages of the golfer's forward swing, respectively.
Figure 4B:
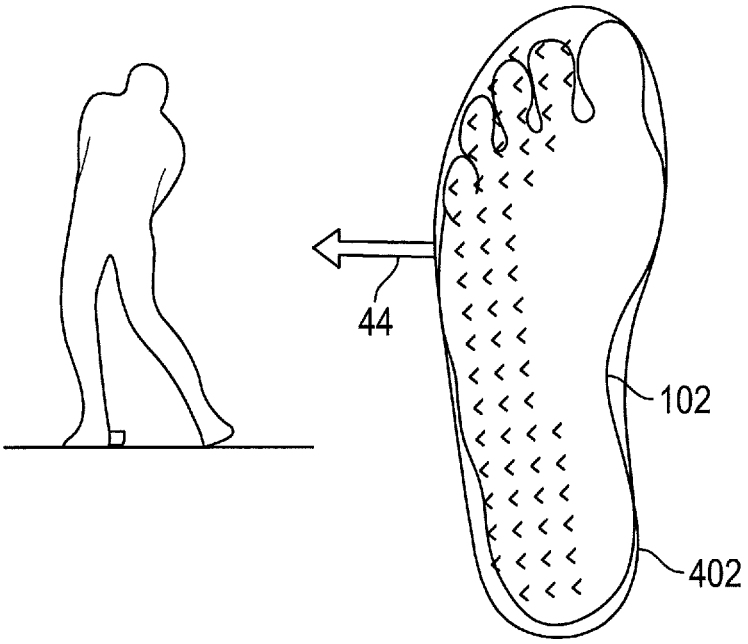

FIGS. 4A and 4B illustrate different directional horizontal forces exerted on the front foot 102 within an outline of a sole 402 at an intermediate transition stage during the forward swing and at impact with the golf ball, respectively. As these figures illustrate, the direction of the horizontal forces changes from a lateral, slightly forward direction as indicated by arrow 42 in FIG. 4A, to a substantially lateral direction at impact as indicated by arrow 44 in FIG. 4B.

In one embodiment of the invention, described in further detail below, the contoured ribs at the top of the outsole (e.g., at the forward portion) and spikes (macro spikes and micro spikes) at the bottom of the outsole (bottom outsole) of the contoured thin sole facilitates better foot control, especially at concentration points for pivoting and compensating for these directional forces exerted during the forward swing, to optimize performance during the forward swing.

Figures 5A, 5B, 5C, 5D, 5E:
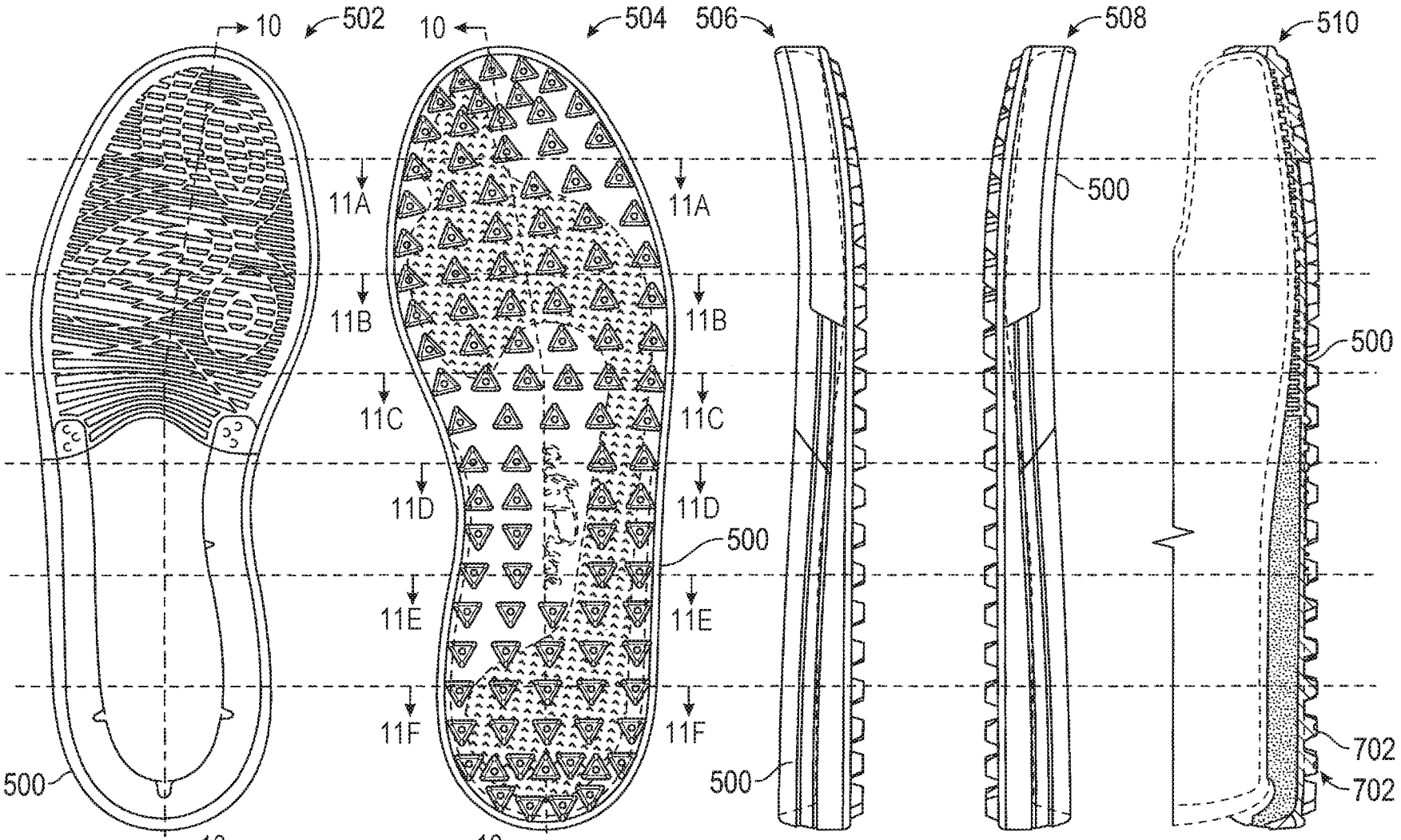
FIGS. 5A-5E illustrate various views of a contoured thin sole with relative points of reference that will be further discussed in the following figures, in accordance with an embodiment of the invention.

FIGS. 5A-5E illustrates various views of a contoured thin sole 500 with relative points of reference that will be further discussed in the following figures, in accordance with one embodiment of the invention. As illustrated, FIG. 5A includes a perspective top view 502 of an exemplary contoured thin sole 500 (discussed further below in connection with FIGS. 6A and 6B). FIG. 5B illustrates a perspective bottom view 504 of the bottom outsole of the contoured thin sole 500 (discussed further below in connection with FIG. 7). FIG. 5C illustrates a perspective medial view 506 of the contoured thin sole (discussed further below in connection with FIG. 8). FIG. 5D illustrates a perspective lateral view 208 of the contoured thin sole (discussed further below in connection with FIG. 9); and FIG. 5E illustrates a cross sectional view 510 along cross sectional line 10-10 of the contoured thin sole as shown in FIG. 5B (discussed further below in connection with FIG. 10).

Furthermore, as illustrated in FIG. 5B, various cross sectional lines are indicated that will be referred to in later figures. For example, as illustrated across the perspective bottom view 504, cross sectional line 10-10 (along a longitudinal central axis) is referenced below in connection with FIG. 10. Also, as illustrated across the perspective bottom view 504 of FIG. 5B, cross-sectional views along cross sectional lines 11A-11A, 11B-11B, 11C-11C, 11D-11D, 11E-11E, and 11F-11F are discussed in further detail below in connection with FIGS. 11A, 11B, 11C, 11D, 11E, and 11F.

Figure 6A:
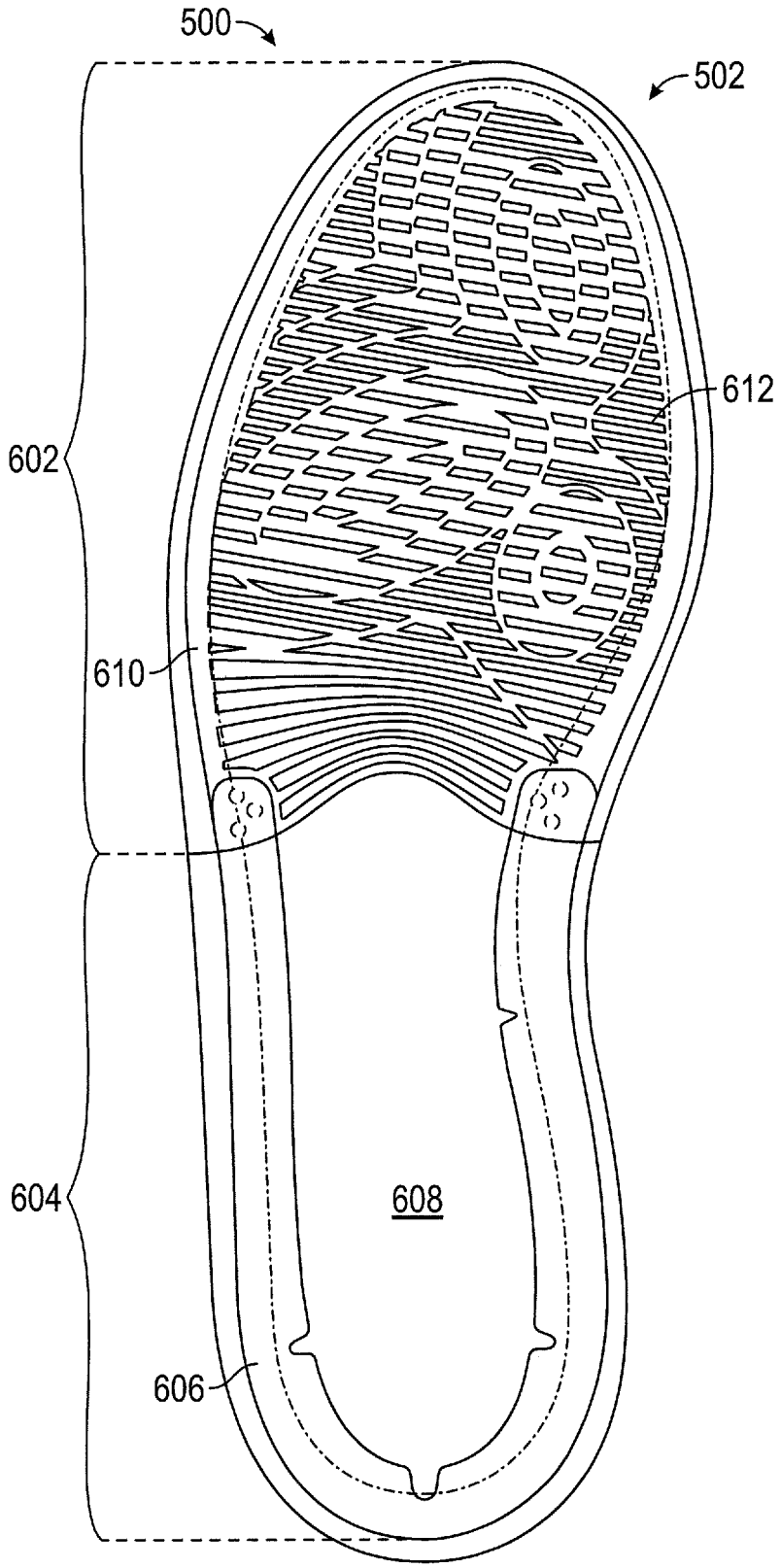
FIGS. 6A and 6B illustrate perspective top views of the contoured thin sole introduced in FIGS. 5A-5E, in accordance with an embodiment of the invention.

FIG. 6A illustrates the perspective top view 502 of the exemplary contoured thin sole 500 shown in FIG. 5A, in accordance with an embodiment of the invention. As illustrated in FIG. 6A, the contoured thin sole 500 includes a forward portion 602 and a rear portion 604. As will be discussed below in connection with FIG. 10, the rear portion 604 may be a thicker, padded portion of the contoured thin sole 500. The rear portion 604 may include a rear portion midsole reinforcement structure 606 that at least partially surrounds a cushion structure 608. The rear portion midsole reinforcement structure 606 may be made of a rigid material to provide support to the rear portion 604 of the contoured thin sole 500. The cushion structure 608 may be made of a foam, or other type of cushion material such as a Boost™ foam material, as described in further detail below.

The forward portion 602 may be a thinner and more flexible portion of the contoured thin sole 500, relative to the rear portion 604. The forward portion 602 may include a forward portion reinforcement structure 610 that at least partially surrounds the forward portion 602. As shown in FIG. 6A, the forward portion 602 includes a plurality of ribs that are sized, shaped and arranged with respect to one another (collectively referred to herein as a "contoured rib structure 612") to provide desired flexibility, cushion and rigidity characteristics as described in further detail below. Specifically, the contoured rib structure 612 will be discussed further below in connection with FIG. 6B. The forward portion reinforcement structure 610 may be more flexible and less rigid than the rear portion midsole reinforcement structure 606. Both the forward portion reinforcement structure 610 and the rear portion midsole reinforcement structure 606 may be made of the same or different types of materials. In some embodiments, the forward portion reinforcement structure 610 may be made from a more flexible material than the rear portion midsole reinforcement structure 606. Also, in some embodiments, the combination of the forward portion reinforcement structure 610 and the rear portion midsole reinforcement structure 606 may completely surround the cushion structure 608 and the contoured rib structure 612.

In some embodiments, the forward portion 602 may be made from a polymer, such as a rubber. In other embodiments, the forward portion 602 may be made from a relatively light ethyl vinyl acetate (EVA), thermoplastic polyurethane (TPU), or rubberized TPU material that substantially allows the forward portion 602 to easily stretch and deform, thereby providing increased flexibility. For example, rubberized TPU may be TPU with some percentage of rubber in the TPU compound for better anti-abrasion durability and versatility than a pure TPU compound, especially on slippery surfaces (e.g., a tile floor, pavement, and cart path). In alternative embodiments, the forward portion 602 may be made from a combination of materials, such as a combination of polymer, EVA, rubberized TPU, or TPU. Also, in some embodiments, the forward portion 602 and the outsole (discussed further below) may be formed of a same material and may be made by injection molding and formed as single integral piece.

Also, as discussed above, the cushion structure 608 (also referred to herein as a "midsole") disposed on top of the contoured thin sole 500 at the rear portion 604 may be made of a foam, or other type of cushion material such as a Boost™ foam material, which is described in further detail below. This cushion structure 608 may be formed on the top outsole, such as by being poured on and hardened (e.g., formed) within, or by being adhered to (e.g., glued) a space (e.g., a cavity) configured to receive the cushion structure 608 at the top outsole.

In one embodiment, the rear portion midsole reinforcement structure 606 may be made from a relatively dense ethyl vinyl acetate (EVA), thermoplastic polyurethane (TPU), or rubberized TPU material that substantially prevents portions of the contoured thin sole 500 covered by the rear portion midsole reinforcement structure 606 from collapsing or substantially stretching in an outwardly direction, thereby providing increased strength and stability to the contoured thin sole 500. Also, the forward portion reinforcement structure 610 may be made from a relatively flexible ethyl vinyl acetate (EVA), thermoplastic polyurethane (TPU), or rubberized TPU material. The forward portion reinforcement structure 610 and the rear portion midsole reinforcement structure 606 may be formed on or adhered to a previously formed forward portion 602 and cushion structure 608 of the contoured thin sole 500.

Figure 6B:
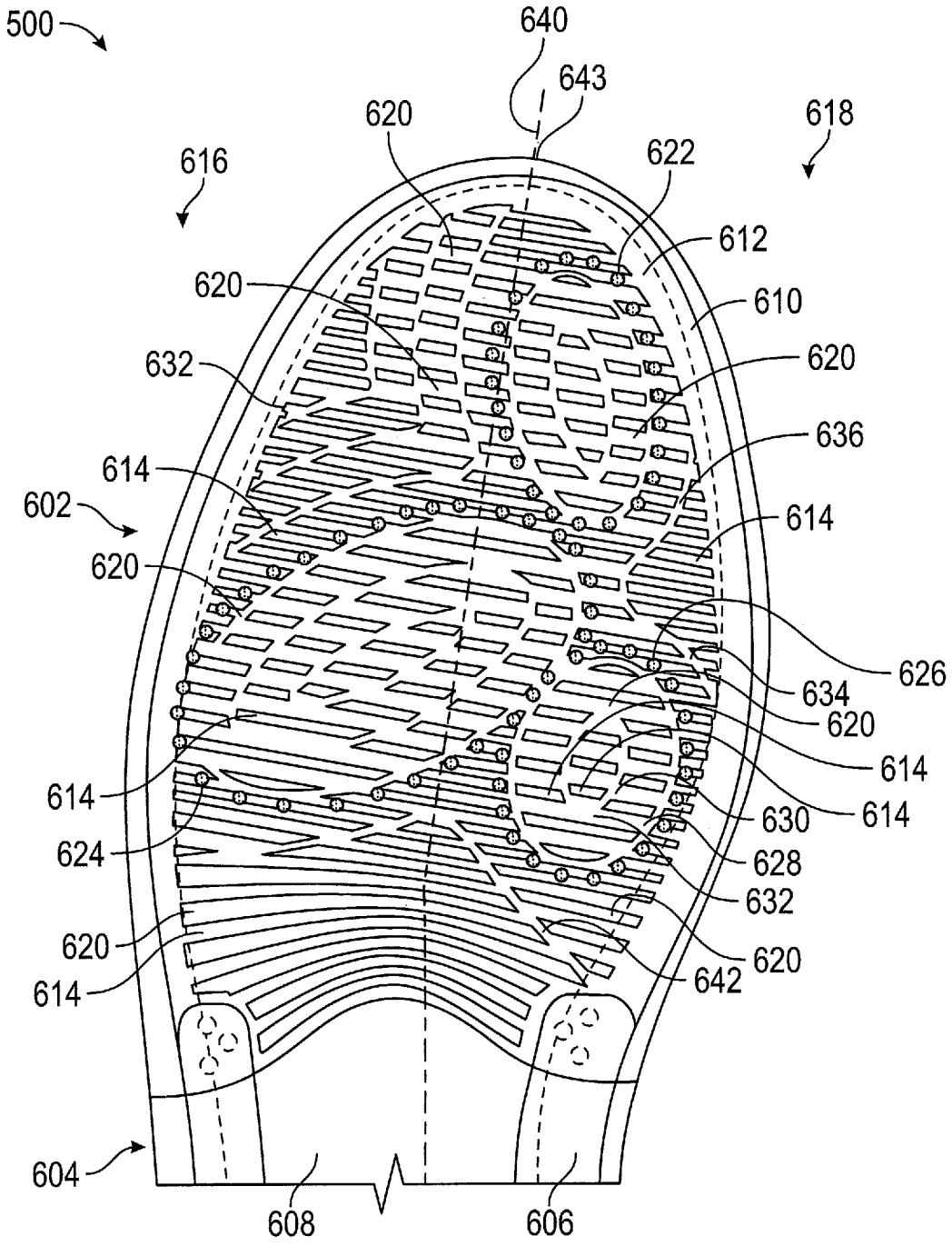

FIG. 6B illustrates a perspective top view of the contoured thin sole 500 introduced in FIG. 6A but further enlarged to more clearly show features of the forward portion 602, in accordance with an embodiment of the invention. As introduced above, the contoured rib structure 612 may include various ribs 614 having lengths generally extending between the lateral side 616 and medial side 618 of the contoured thin sole 500. As shown in FIG. 6B, the ribs 614 that may be patterned, or contoured, across the forward portion 602. With reference to FIG. 6B, the term "horizontal" refers to a direction of travel between the lateral side 616 and medial side 618 of the contoured thin sole 500. The term "longitudinal" refers to a direction that is perpendicular to "horizontal" along a surface of the contoured thin sole 500 with respect to FIG. 6B. Also, the term "vertical" refers to a direction that is perpendicular to "horizontal" not along a surface of the contoured thin sole 500 with respect to FIG. 6B.

The patterning and contouring of the plurality of ribs 614 provides numerous horizontal spaces 620 (i.e., separations) that allow each of the ribs 614 to bend or expand into as various directional forces are applied to each rib 614 during various sporting activities (e.g., pivoting and bending during a golf swing). Accordingly, horizontal fold flexibility (e.g., bending along a horizontal axis extending between the lateral side 616 and the medial side 618 of the contoured thin sole 500) may be enhanced due at least to the give from compression, or deformation, of the horizontally extending ribs into the horizontally extending spaces. Although the term horizontal is used to describe the ribs 614 and the spaces 620, the ribs 614 and the spaces 620 may not necessarily be horizontal (as will be discussed further below), but rather may be generally horizontal, such as being skewed, arced or curved and/or with greater portions of the ribs 614 and/or the spaces 620 between the ribs 614 generally extending in a horizontal orientation. Furthermore, in alternative embodiments, each of the plurality of ribs 614 may be patterned and contoured in various ways to provide desired rigidity, flexibility, cushioning and compressibility profiles or characteristics to accommodate various different types of dynamic forces during an activity. For example, in some embodiments, some or all of the ribs 614 may run in a substantially longitudinal and/or diagonal direction with respect to FIG. 6B. As used herein, rib "patterning and contouring" refers to arranging the size, shape, directions and spacing between the plurality of ribs 614 ways to provide desired rigidity, flexibility, cushioning and compressibility characteristics.

Furthermore, the ribbed patterning and contouring may include various rib 614 widths (e.g., along a longitudinal axis) and spacing (e.g., density, or amount, of ribs 614 in a given area) that may put concentration points of the foot (e.g., areas of the foot that bear greater force for reasons such as pivoting or stability, as discussed above) closer to the ground than other areas of the foot. In certain embodiments, at least some of the ribs 614 within a given area (e.g., sections 622, 624 and 626) may be contoured to be thinner at particular locations of the contoured rib structure. For example, the ribs may be thinner and less dense (e.g., have more spacing between ribs for a given area) in a location of the contoured thin sole 500 across the longitudinal central axis and across the transition between the metatarsal bones and the phalange bones of an overlying foot. As used herein, the terms "thinner" and "thicker," and conjugates thereof, refer to a height of a rib, or other structure above a plane or surface parallel to a ground plane. As another example, the ribs may be less dense along a section of the midsole that the big toe (e.g., hallux), big toe pad (e.g., a portion of the foot bottom at the transition of the big toe metatarsal bone and the phalange of the big toe), lateral pad (e.g., a portion of the foot bottom at the transition between the metatarsal bones and the phalange bones of toes other than the big toe), or general pad (the portion of the foot bottom that includes the big toe pad and the lateral pad) may rest upon. Specifically, a big toe section 622 (demarcated by dotted lines) of the contoured rib structure 612 may be configured to receive a big toe of a foot, a lateral pad section 624 (demarcated by dotted lines) of the contoured rib structure 612 may be configured to receive the lateral pad of the foot, and a big toe pad section 626 (demarcated by dotted lines) of the contoured rib structure 612 may be configured to receive the big toe pad of the foot.

As illustrated, each of these sections 622, 624, 626 outlines a defined area or region within the contoured rib structure 612 that substantially circumscribes (i.e., surrounds) these sections 622, 624, 626. In the illustrated embodiment, the sections 622, 624, 626 are shaped as ellipses. However, it is understood that any desired shape may be implemented in accordance with various embodiments of the invention. Also, in some embodiments, the density of the ribs 614 may decrease (e.g., the spacing between the ribs may be greater) and/or a thinness of the ribs 614 toward the center of each section may decrease. In particular embodiments, the contoured rib structure 612 may be thinnest and least dense at the center of the sections 622, 624 and/or 626, relative to the contoured rib structure 612 outside of the sections 622, 624 and 626. Also, each section may include at least one concentric set of spacings defined by the patterning and contouring of the ribs 614 in that section. For example, the big toe pad section 626 is circumscribed by a first elliptical spacing 628 and, closer to the center of the big toe pad section 626, contains a second elliptical spacing 630 concentric with the first elliptical spacing 628. Furthermore, the density of the ribs 614 circumscribed by the second elliptical spacing 630 (i.e., closer to the center of the big toe pad section 626) is less than the density of the ribs between the second elliptical spacing 630 and the first elliptical spacing 628, in accordance with some embodiments. Stated another way, the spacing within (and inclusive of) the second elliptical spacing 630 between ribs 614 may be greater than the spacing outside of (and not inclusive of) the second elliptical spacing 630 and bound by the first elliptical spacing 628.

Furthermore, additional elliptical concentric spacings may be formed that concentrically radiate outward from the sections 622, 624, 626. For example, a concentric spacing 634 may at least partially surround the big toe pad section 626, as shown in FIG. 6B. That concentric spacing 634 may link up with other concentric spacing 636, which at least partially surrounds the big toe section 622, to form a continuous spacing that meanders between the ribs 614, as shown in FIG. 6B.

Additionally, the ribs 614 within the sections 622, 624, 626, on which concentration points of the foot may rest, may also have ribs 614 that are thinner, i.e., shorter as measured from a lower surface of the top outsole 632 that the ribs protrude from, when compared to other parts of the contoured rib structure 612, in accordance with some embodiments. Furthermore, the thinness of the ribs may not be equal within each section 622, 624, 626, in some embodiments. In certain embodiments, the ribs 614 within the lateral pad section 624 may be thinner than the ribs 614 within the big toe pad section 626, which may be thinner than the ribs 614 within the big toe section 622. Also the ribs may become thinner, be more spaced apart, or occupy less cross sectional area the closer the ribs are to each of the sections 622, 624, 626.

Accordingly, the ribbed contouring may include a patterning of ribs 614 that are disconnected and/or offset from each other. This patterning may conform to a heat map that indicates areas where the greatest amounts of force or pressure are exerted during a given activity, e.g., the concentration points at the center of each section 622, 624, 626, with the ribs becoming denser, larger, and/or thicker with greater distance away from the concentration points. Furthermore, the patterning may include patterned spacings 620 between the ribs 614 that may form concentric ellipses of spacings 620 between the ribs 614 that radiate from (i.e., form larger concentric ellipses) from the center of the sections 622, 624, 626. Furthermore, the ribs 614 may be offset (i.e., not extending along one continuous line across the lateral and medial sides) for greater spacing 620 between ribs 614 and for greater flexibility and compression (such as for enhanced horizontal fold flexibility) and lower center of gravity control at the concentration points (e.g., pivot points) of the foot that rest upon the sections 622, 624, 626. In some embodiments, the various ribs in sections 622, 624 and 626 can have a height (i.e., thickness) in the range of 0.5-10.0 millimeters (mm), a width in the range of 0.5-10 mm, and a length in the range of 1.0-100 mm. Outside of sections 622, 624 and 626, as shown in FIGS. 6A and 6B, the various ribs 614 can have a height (i.e., thickness) in the range of 0.5-10 mm, a width in the range of 0.5-10 mm, and a length in the range of 1.0-100 mm.

Additionally, the ribs 114 may be arced (i.e., curved), but may still extend between the lateral 616 and medial sides 618, to generally follow the longitudinal central axis 640 (along the center of the contoured thin sole 500 from the most forward part 643 of the contoured thin sole 500 to the most rear part of the contoured thin sole 500) that curves along with the asymmetrical curves of the contoured thin sole 500. In certain embodiments, the ribs 114 (that extend horizontally) may include longitudinal connections 642 that connect horizontal ribs 114 longitudinally to make the horizontal ribs 114 more rigid, such as in areas of the contoured thin sole 500 closer to the transition between the flexible forward portion 602 and the more rigid, thicker, padded, less flexible rear portion 604 of the contoured thin sole 500. The ribs 114 with an arc may be more prevalent in areas of the contoured thin sole 500 closer to the transition between the forward portion 602 and the rear portion 604 of the contoured thin sole 500.

Figure 7:
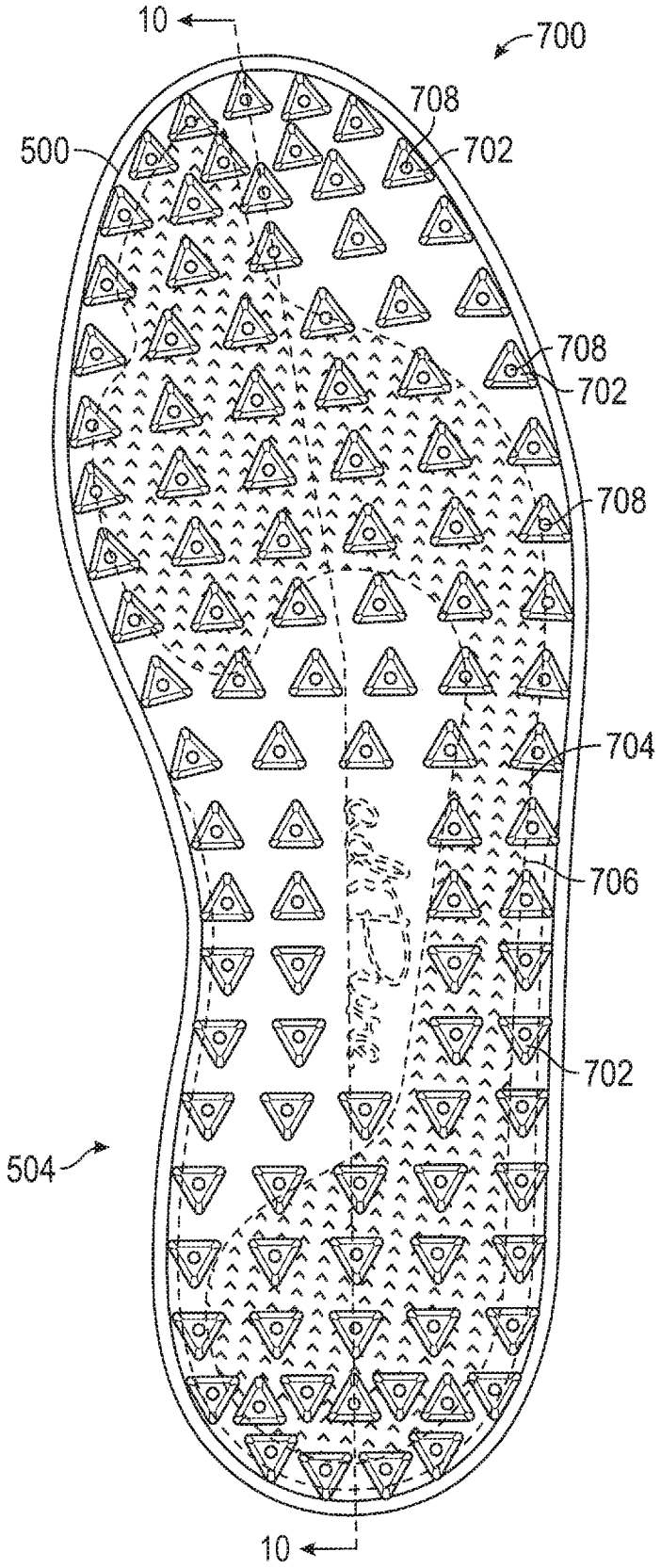
FIG. 7 illustrates a perspective bottom view of the contoured thin sole introduced in FIGS. 5A-5E, in accordance with an embodiment of the invention.

FIG. 7 illustrates a perspective bottom view 504 of an exemplary bottom outsole 700 of the contoured thin sole 500 shown in FIG. 5B, in accordance with an embodiment of the invention. As illustrated, the bottom outsole 700 may include an arrangement of macro spikes 702 (i.e., protrusions) and micro spikes 704 (i.e., protrusions smaller than the macro spikes) across the surface of the bottom outsole 700. The micro spikes 704 may be bounded within a micro spike region 706 along the bottom outsole 700. Also, the macro spikes 702 may include micro cavities 708, or depressions, at the center of the macro spikes 702. The micro cavities 708 may contour the part of the macro spike 702 that may touch the ground underneath the bottom outsole 700 to enhance traction against the ground during sporting actives.

The macro spikes 702 may be generally evenly distributed along the bottom outsole 700 to provide traction during ambulatory sporting activities such as walking or running along grass or dirt. For example, the macro spikes 702 may form protrusions that may dig into the ground to provide traction for the ambulatory sporting activities.

As introduced above, forces (e.g., vertical or horizontal) may be concentrated, such during the performance of activities such as a golf swing, along the lateral edge portions and the big toe and big toe pads of the foot. Also, portions of the bottom outsole 700 upon which the lateral edge, big toe, big toe pads and the lateral pad rests may correspondingly incur a greater amount of force than other portions of the bottom outsole. In addition, during ambulatory activities, force may also be applied to the heel of a foot. Thereby, the heel (at the rear) of an bottom outsole 700 may also incur a greater amount of force than other portions of the bottom outsole 700.

Accordingly, the micro spike region 706 (within which the micro spikes 704 are bound) may be along regions of the bottom outsole that may incur a greater amount of force than other parts of the bottom outsole 700 (such as the portions of the bottom outsole that support the lateral edge, big toe, big toe pads, lateral pad and heel of the foot). The micro spikes 704 may be distributed between the macro spikes 702 within the micro spike region 706 for greater traction during ambulatory sporting activities over soft ground that the macro spikes 702 may sink into such that the micro spikes 704 (smaller than and between the macro spikes 702) may also contact the underlying soft ground and provide additional traction during the ambulatory sporting activities.

The bottom outsole 700, including the macro spikes and micro spikes, may be made of a firm but flexible rubberized material that provides resilience and well as flexibility during use of the bottom outsole. In one embodiment, the bottom outsole 700 may be made from an ethylene-vinyl acetate (EVA), thermoplastic polyurethane (TPU), or rubberized TPU material, and can be injection molded with one or more types of thermoplastic polyurethane (TPU) or rubberized TPU. In some embodiments, the bottom outsole 700 may be made from a polymer, such as a rubber. In other embodiments, the bottom outsole 700 may be made from a combination of the polymer and other materials, such as the EVA, TPU, or rubberized TPU. Also, as discussed above, the bottom outsole 700 and the top outsole 632 (discussed above in connection with FIG. 6B) are the top and bottom, respectively, of the outsole. Accordingly, the top outsole 632 and the bottom outsole 700 (as illustrated in FIG. 7) may be formed from the same material and may be made by injection molding and formed as single integral piece.

Figure 8:
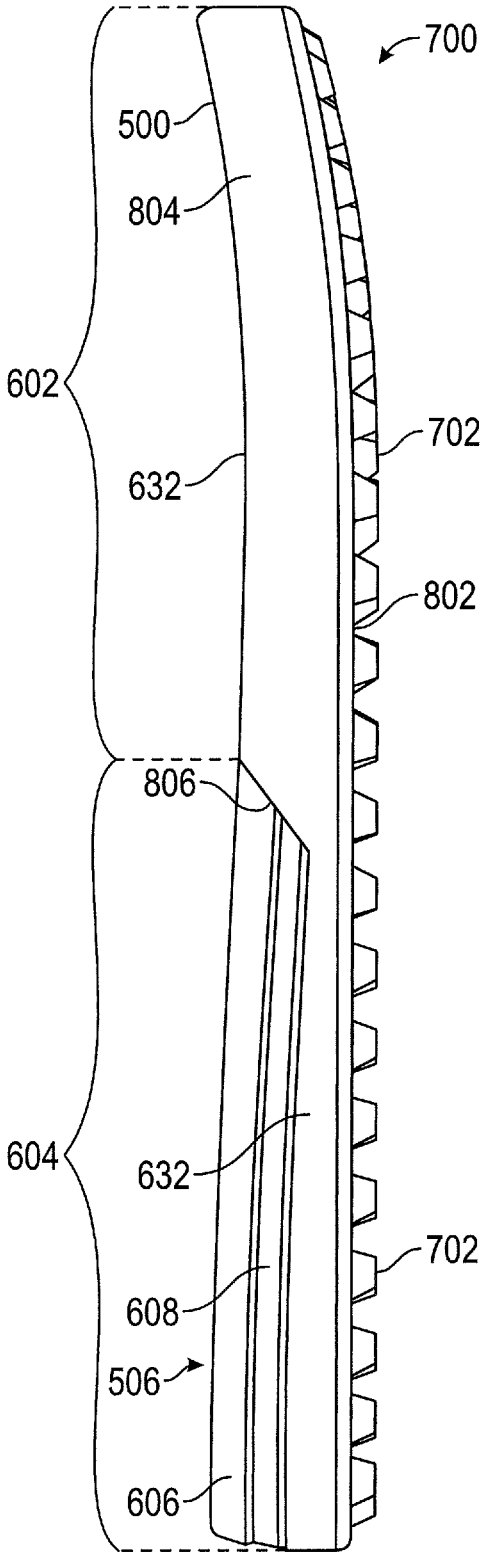
FIG. 8 illustrates a perspective medial view of the contoured thin sole introduced in FIGS. 5A-5E, in accordance with an embodiment of the invention.
Figure 9:
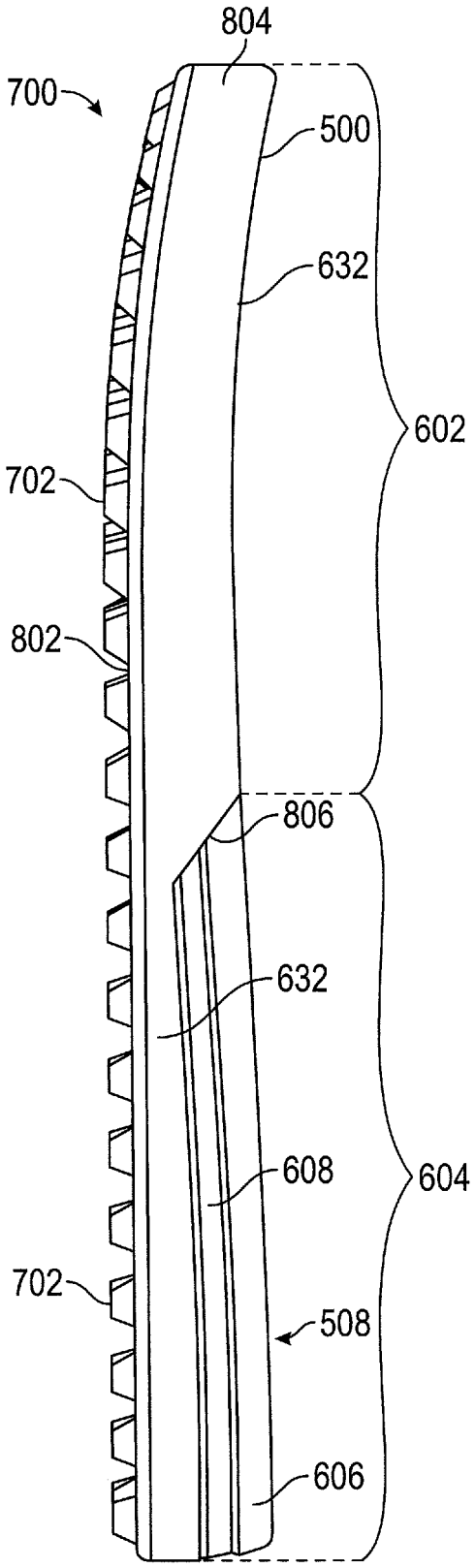
FIG. 9 illustrates a perspective lateral view of the contoured thin sole introduced in FIGS. 5A-5E, in accordance with an embodiment of the invention.

FIG. 8 illustrates a perspective medial view 506 of the contoured thin sole 500, in accordance with an embodiment of the invention. Also, FIG. 9 illustrates a perspective lateral view 508 of the contoured thin sole 500, in accordance with an embodiment of the invention. FIGS. 8 and 9 will be discussed together for ease of discussion. As illustrated in FIGS. 8 and 9, the macro spikes 702 (introduced above) may be distributed across the bottom outsole 700 and may protrude from a bottom surface 802 of the bottom outsole 700.

As further illustrated in FIGS. 8 and 9, the contoured thin sole 500 may include a reinforcement border 804 surrounding at least the forward portion 602 of the contoured thin sole 500. The reinforcement border 804 may define and surround the outer periphery of the contoured thin sole 500 to provide further stability and rigidity to the overall contoured thin sole 500. The reinforcement border 804 may be formed of flexible materials such as a polymer; rubber; TPU; rubberized TPU; EVA; a combination of polymer, rubber, TPU, rubberized TPU, EVA; or may also include other suitable materials of similar properties depending on application and desired characteristics. In certain embodiments, the reinforcement border 804 may be made of materials different than materials used in other portions of the contoured thin sole 500. For example, in some embodiments, the reinforcement border 804 is made of a different material than the material of the outsole (e.g., the bottom outsole 700 and the top outsole 632) of the contoured thin sole 500. The reinforcement border 804 may be attached to the sides of the outsole (e.g., the bottom outsole 700 and the top outsole 632) by means of gluing, bonding, stitching or other attaching means. In alternative embodiments, the reinforcement border 804 may be made from the same material as the outsole (e.g., the bottom outsole 700 and the top outsole 632) and integrally formed therewith (e.g., via injection molding).

As illustrated in FIGS. 8 and 9, the reinforcement border 804 may also surround the rear portion 604 of the contoured thin sole 500 to define the shape of the rear portion 604 of the contoured thin sole 500 and provide further stability and rigidity thereto. The reinforcement border 804 may include a slanted contour 806 from which the reinforcement border 804 becomes thinner (i.e., less tall) as it wraps around the periphery of the rear portion 604 of the contoured thin sole 500. In some embodiments, the rear portion midsole reinforcement structure 606 is attached to the reinforcement border 804 at the slanted contour 806 and at least partially surrounds the outer periphery of the cushion structure 608 to provide increased rigidity and support to the cushion structure 608. As shown in FIGS. 8 and 9, in some embodiments, the cushion structure 608 may be exposed through a gap between the rear portion midsole reinforcement structure 606 and the reinforcement border 804 to allow the cushion structure to expand outwardly through the gap when compressed during use of the contoured thin sole 500, thereby providing additional compression and flexibility to the cushion structure 608.

As illustrated in FIGS. 8 and 9, the bottom outsole 700 refers to a bottom surface of an outsole of the contoured thin sole 500, and is configured to touch the ground. The top outsole 632 refers to a top surface of the outsole of the contoured thin sole 500 from which the plurality of ribs can protrude in the forward portion 602 (of the contoured thin sole 500). The cushion structure 608 may rest on the top outsole 632 along the rear portion of the contoured thin sole 500. Also, as discussed above, the outsole of the contoured thin sole 500 may be a single piece for which the top outsole 632 is a top side of the outsole and the bottom outsole 700 is a bottom side of the outsole. Accordingly, as discussed above, the bottom outsole 700 and the top outsole 632 may be integrally formed, such as by being injection molded from a common material.

Figure 10:
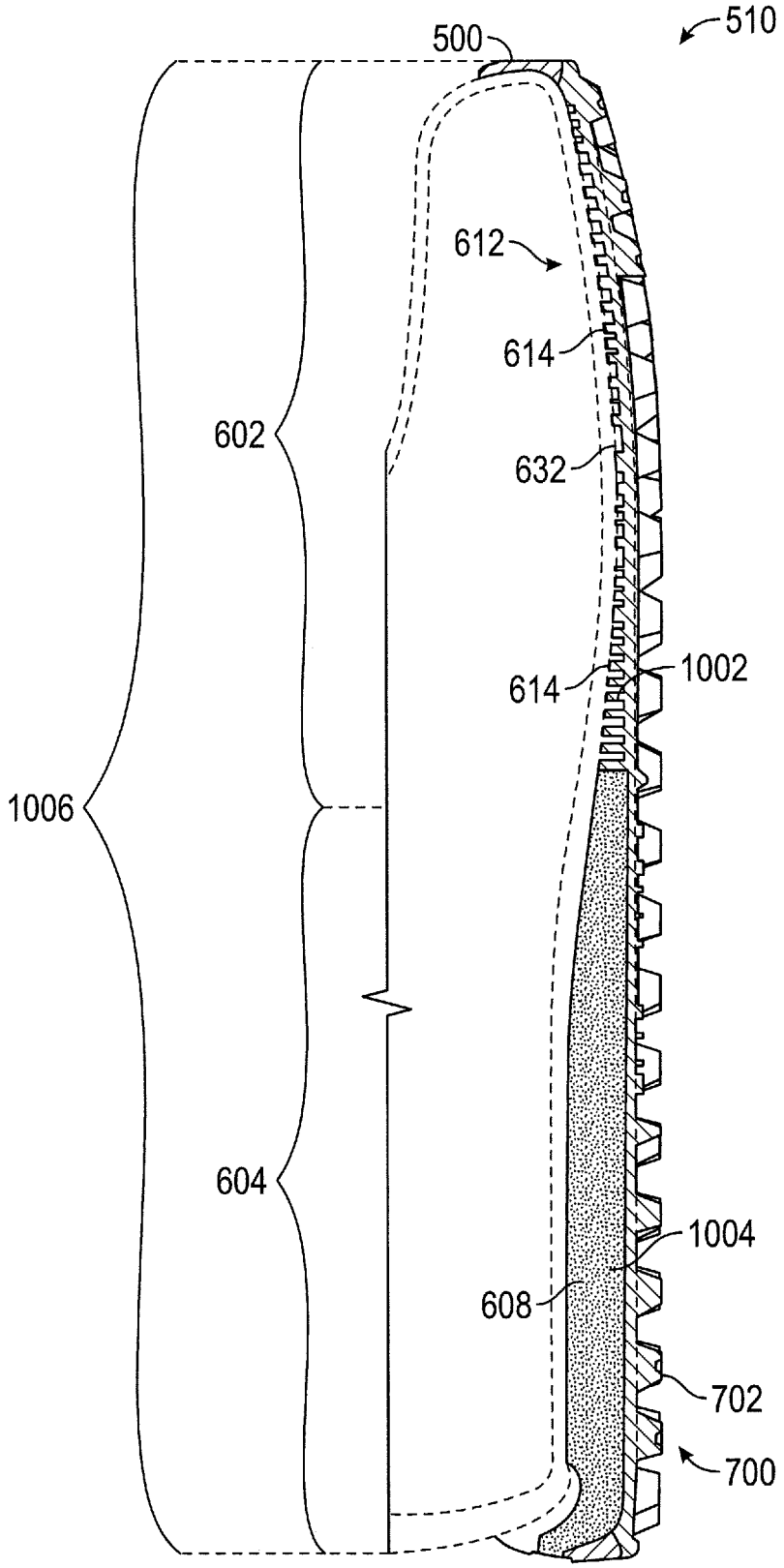
FIG. 10 illustrates a cross sectional view along cross section 10-10 of the contoured thin sole introduced in FIGS. 5A-5E, in accordance with an embodiment of the invention.

FIG. 10 illustrates a cross sectional view 510 along cross section A-A of the contoured thin sole 500 shown in FIG. 5B, in accordance with an embodiment of the invention. As illustrated, the contoured thin sole 500 along the longitudinal central axis (i.e., 10-10) crosses between the thicker padded rear portion 604 and the thinner, flexible forward portion 602 of the contoured thin sole 500. The bottom outsole 700 may include macro spikes 702, as discussed above. The forward portion 602 may include ribs 614 formed from a polymer material, as discussed above. As shown in FIG. 10, in accordance with some embodiments, the top outsole 632 (having a plurality of ribs 614) and bottom outsole 700 may be integrally formed from a flexible material 1002. As discussed above, the top outsole 632 and the bottom outsole 700 may be formed together (e.g., injection molded) of flexible materials 1002 such as a polymer; rubber; TPU; rubberized TPU; EVA; a combination of polymer, rubber, TPU, rubberized TPU, EVA; or may also include other suitable materials of similar properties depending on application and desired characteristics. In alternative embodiments the forward portion 602 and corresponding contoured rib structure 612 may be made from a different material than the bottom outsole 700 and thereafter adhered to a top outsole 632 at a location corresponding to the forward portion 602, as shown in the Figures herein.

In some embodiments, the cushion structure 608 (at the rear portion 604 above the top outsole 632, also termed as the midsole) can be made from a different material (e.g., Boost™ foam 1004, or similar material) than the bottom outsole 700 and/or top outsole 632, and thereafter placed on and adhered to the top outsole 632 at the rear portion 604. Thus, the rear portion 604 may include the cushion structure 608 that is made from a different material that is generally more compressible/elastic and thicker than the ribs 614 of the top outsole 632.

The rear portion 604 and the forward portion 602 forms a transition zone 1006 of a transitioning thickness from the thicker rear portion to the thinner forward portion 602. The forward portion 602 and the rear portion 604 may form a consistent (e.g., non step wise) smooth transition between the two portions 602, 604 (and the different materials of the two portions 602, 604).

As introduced above, the padding material for the cushion structure 608 may be an expanded thermoplastic polyurethanes (TPU or eTPU) material (aka, Boost™ foam). eTPU and other foams based on thermoplastic polyurethanes (TPU) suitable for use to form the midsole, in accordance with various embodiments, are described in further detail in U.S. Pat. App. Pub. No. 2010/0222442 A1, which is incorporated by reference herein in its entirety. Additionally, exemplary methods for production of eTPU using water as a blowing agent or propellant are described in U.S. Pat. App. Pub. No. 2012/0065285 A1.

Figure 11A:
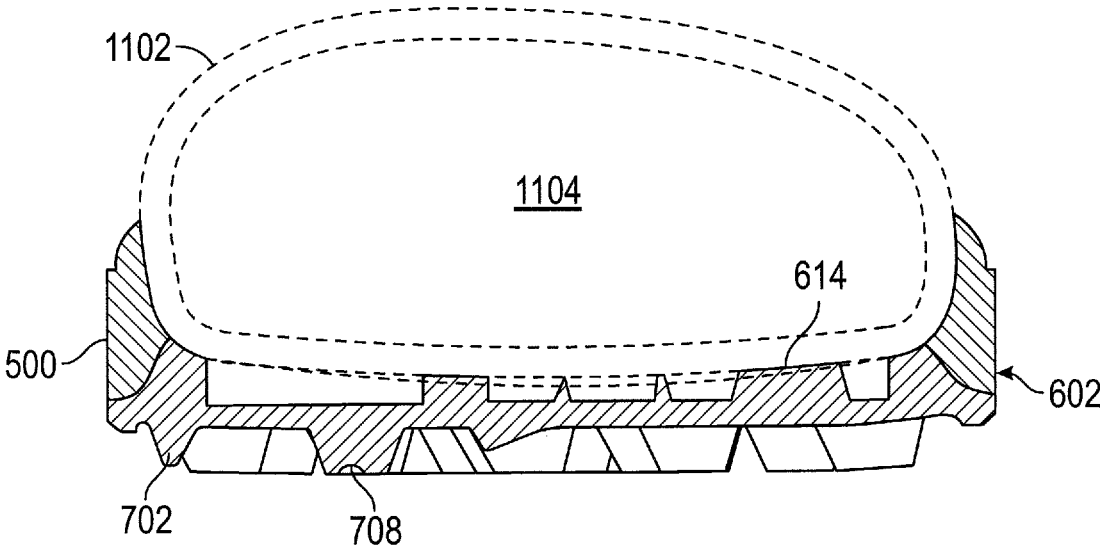
FIGS. 11A, 11B, 11C, 11D, 11E, and 11F illustrate various cross sectional views of the contoured thin sole introduced in FIGS. 5A-5E, in accordance with an embodiment of the invention.
Figure 11B:
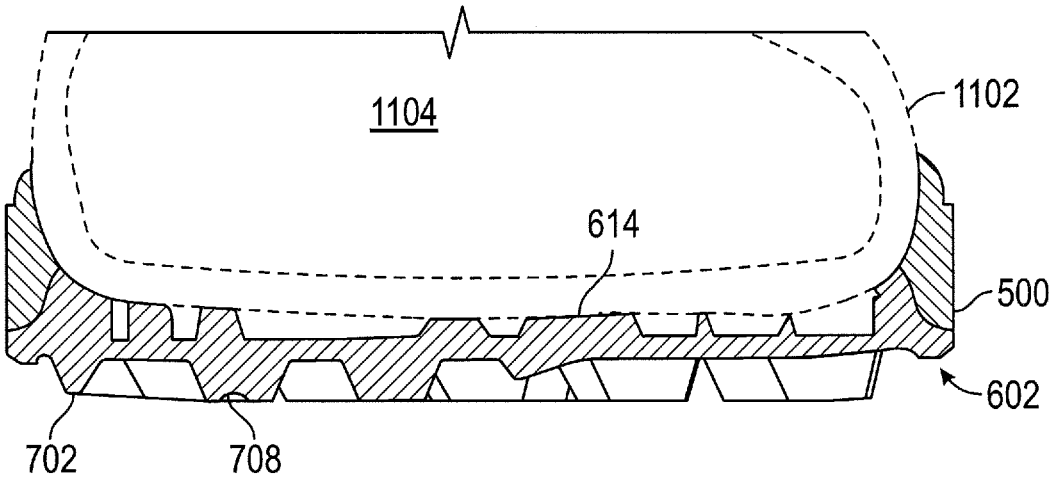
Figure 11C:
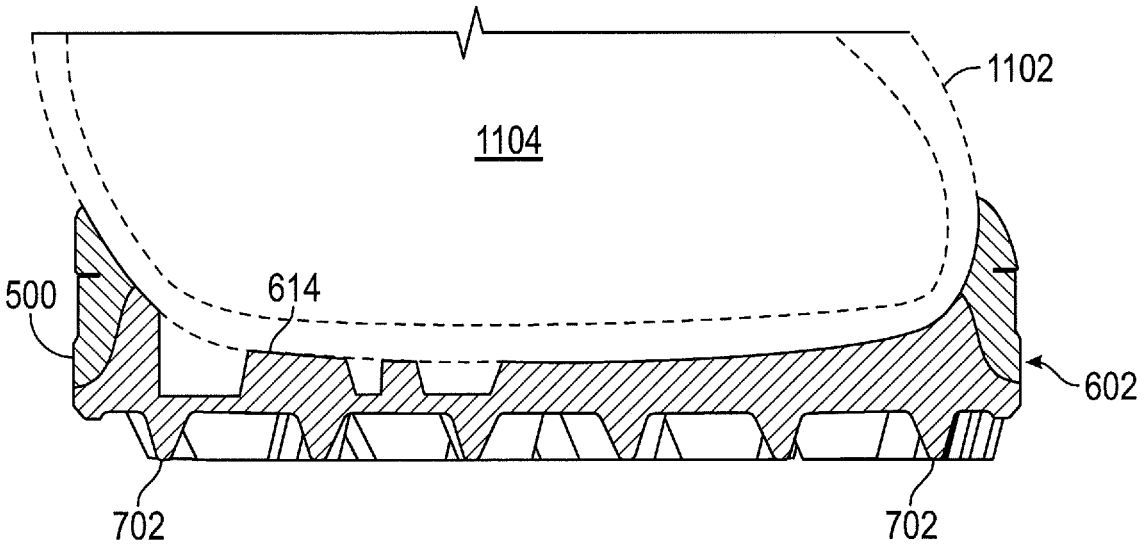
Figure 11D:
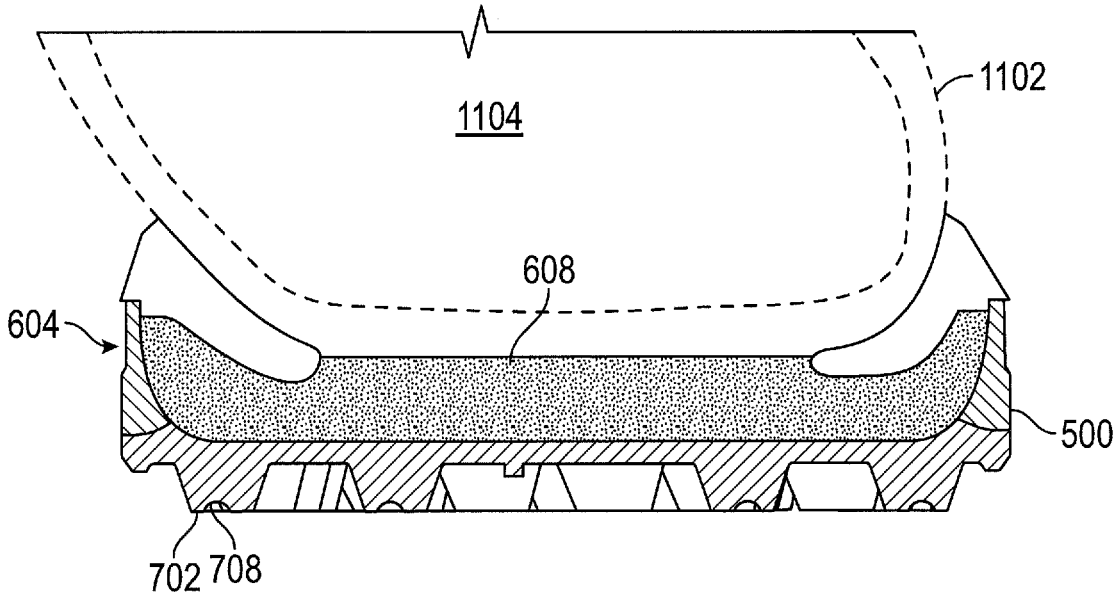
Figure 11E:
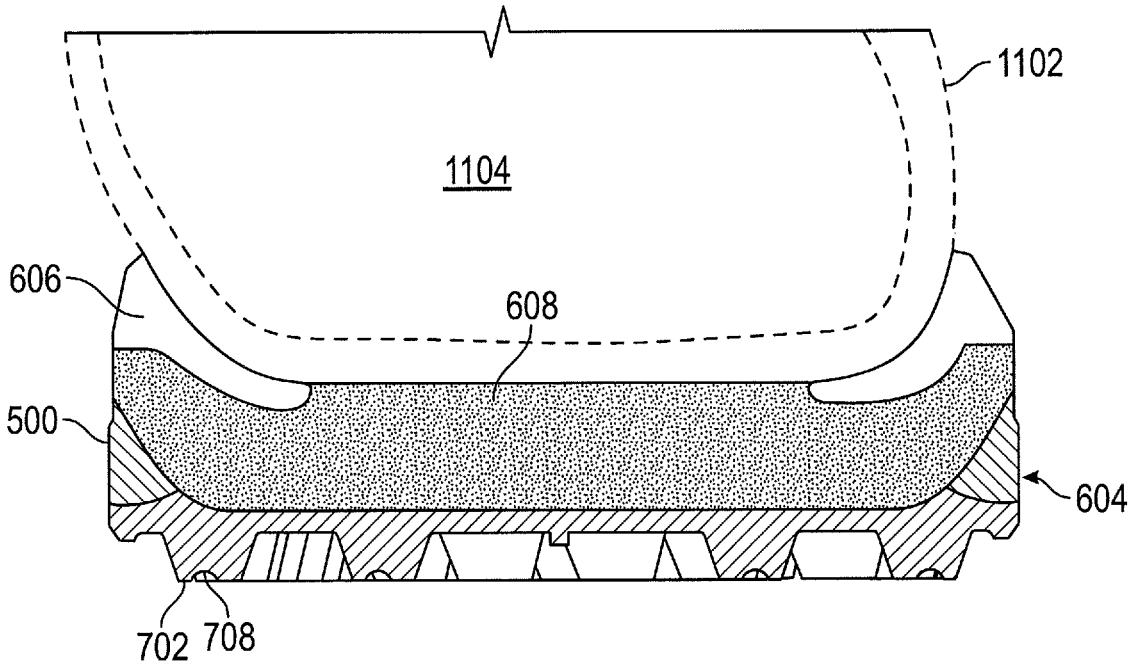
Figure 11F:
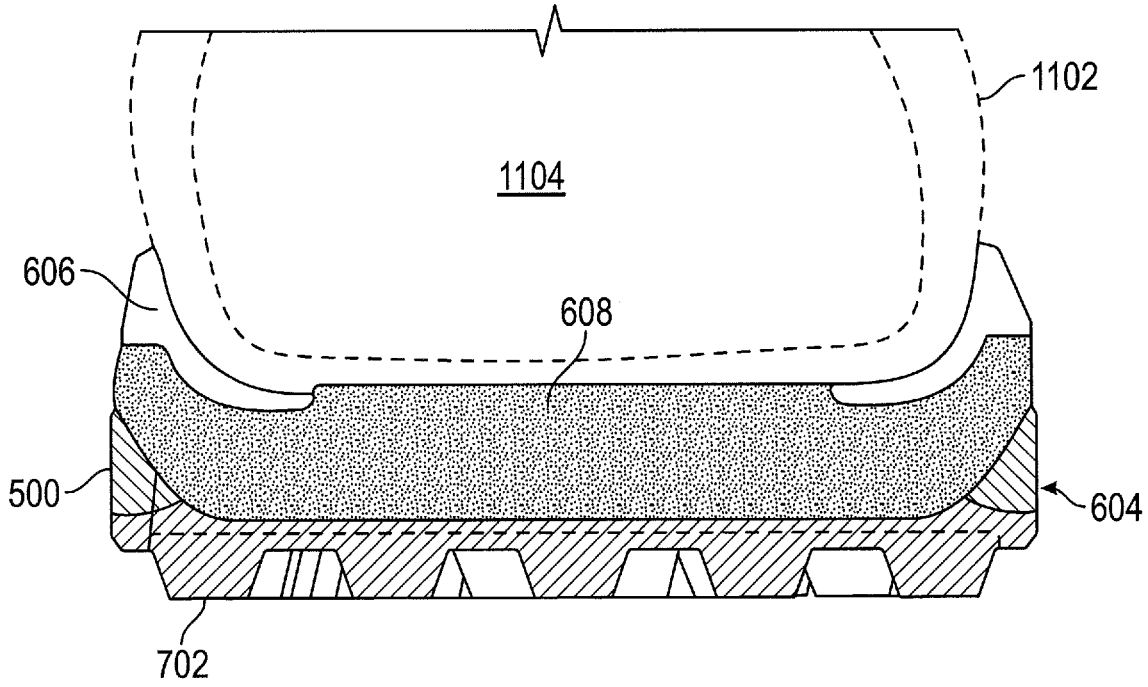

FIGS. 11A, 11B, 11C, 11D, 11E, and 11F illustrate various cross sectional views of the contoured thin sole 500 shown in FIGS. 5A-5E, in accordance with an embodiment of the invention. FIGS. 11A, 11B, 11C, 11D, 11E, and 11F will be initially discussed together for ease of discussion. FIG. 11A illustrates the cross section 11A-11A shown in FIG. 5B. FIG. 11B illustrates the cross section 11B-11B shown in FIG. 5B. FIG. 11C illustrates the cross section 11C-11C shown in FIG. 5B. FIG. 11D illustrates the cross section 11D-11D shown in FIG. 5B. FIG. 11E illustrates the cross section 11E-11E shown in FIG. 5B. FIG. 11F illustrates the cross section 11F-11F shown in FIG. 5B.

As illustrated across FIGS. 11A, 11B, 11C, 11D, 11E, and 11F, the contoured thin sole 500 may support an upper 1102 of a shoe, which include other structures of a shoe that rests upon the contoured thin sole 500. Also, the cross sectional contours of a foot 1104 are illustrated for reference relative to the contoured thin sole 500. Across the various cross sections in FIGS. 11A, 11B, 11C, 11D, 11E, and 11F, ribs 614, a cushion structure 608, a rear portion midsole reinforcement structure 606, macro spikes 702, and micro cavities 708 may be illustrated.

Also, FIGS. 11A, 11B, 11C, 11D, 11E, and 11F as a whole illustrates a progression from the forward portion 602 of the contoured thin sole 500 to the rear portion 604 of the contoured thin sole 500. This progression illustrates a change in thickness that reflects the transition zone 1102 discussed above in connection with FIG. 10. Accordingly, FIGS. 11A, 11B, and 11C illustrates a thinner cross section of the contoured thin sole 500 at the forward portion 602 (relative to the rear portion 604). Also, FIGS. 11D, 11E, 11F, illustrates a thicker cross section of the contoured thin sole 500 at the rear portion 604 (relative to the forward portion 602), where FIG. 11D is thinner than FIG. 11E and FIG. 11F, as FIG. 11D's cross section 11D-11D is closer to the forward portion 602 than either cross section 11E-11E of FIG. 11E or cross section 11F-11F of FIG. 11F.

Figure 12:
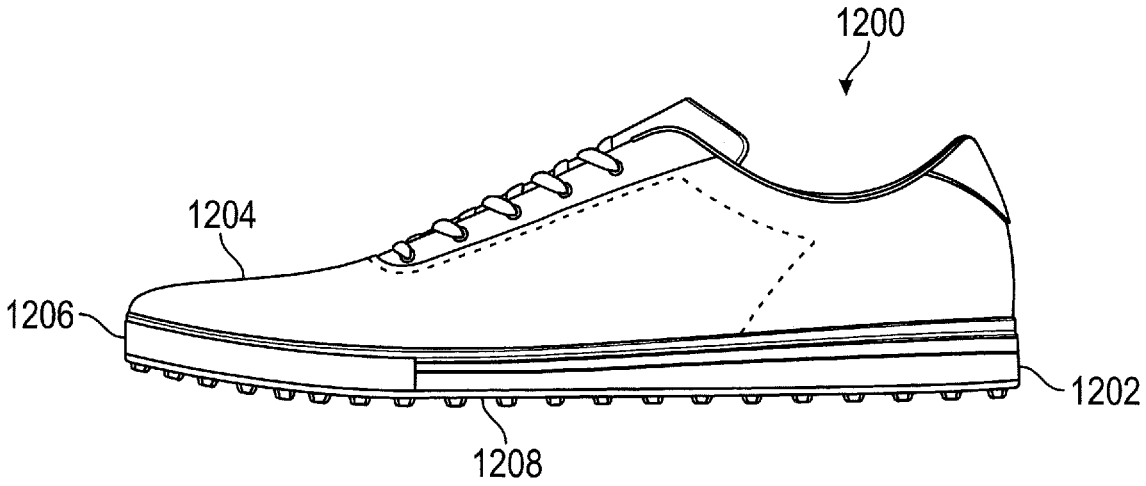
FIG. 12 illustrates a side view of an exemplary shoe with a contoured thin sole, in accordance with an embodiment of the invention.

FIG. 12 illustrates a lateral view of an exemplary shoe 1200 with a contoured thin sole 1202, in accordance with an embodiment of the invention. As illustrated, the shoe 1200 includes an upper 1204 formed on and attached to the contoured thin sole 1202. The contoured thin sole 1202 may include a reinforcement border 1206 and a bottom outsole 1208, as discussed above.

The various elements of the contoured thin sole 1202 and upper 1204 that rests on the contoured thin sole 1202 of the present invention can be made from known suitable materials to achieve desired performance, durability and comfort characteristics. For example, in one embodiment the upper 1204, may be made from a breathable microfiber leather, or similar material, with varying thicknesses in various portions of the upper 1204 to achieve desired characteristics and properties. As another example, in one embodiment, the outsole (also discussed above in connection with FIG. 6A and FIG. 6B) of the contoured thin sole 1202 (illustrated in FIG. 12) can be made with an expanded thermoplastic polyurethane (TPU or eTPU) material (aka, Boost™ foam) or rubberized TPU. eTPU and other foams based on thermoplastic polyurethanes (TPU) suitable for use to form the outsole (e.g., the top outsole and/or bottom outsole 1208 (also discussed above in connection with FIG. 7)), in accordance with various embodiments, are described in further detail in U.S. Pat. App. Pub. No. 2010/0222442 A1, which is incorporated by reference herein in its entirety. Additionally, exemplary methods for production of eTPU using water as a blowing agent or propellant are described in U.S. Pat. App. Pub. No. 2012/0065285 A1, which is incorporated by reference herein in its entirety. In some embodiments, the outsole can comprise a hybrid material comprising a matrix of polyurethane (PU) and foamed particles of TPU or other thermoplastic elastomers, as described in U.S. Pat. App. Pub. No. 2010/0047550 A1, which is incorporated by reference herein in its entirety. Also, as discussed above, rubberized TPU may be TPU with some percentage of rubber in the TPU compound for better anti-abrasion durability and versatility than a pure TPU compound, especially on slippery surfaces (e.g., a tile floor, pavement, and cart path).

Some exemplary advantages of using Boost™ foam as a midsole material is that it is light weight and possesses superior energy-return or rebound properties that promote smooth energy transfer during the swing. The Boost™ foam also results in a lighter weight shoe, which further reduces fatigue to the wearer, especially if he or she is walking a golf course. The Boost™ foam also provides consistent and responsive cushioning across dynamic temperature ranges from subzero cold to punishing heat, thereby retaining its advantageous properties in any weather.

Returning to FIG. 12, in one embodiment, the outsole of the contoured thin sole 1202 (illustrated in FIG. 12) may be made from an ethylene-vinyl acetate (EVA), thermoplastic polyurethane TPU, or rubberized TPU material, and can be injection molded with one or more types of thermoplastic polyurethane (TPU), wherein the midsole can be formed by pouring Boost™ foam material into respective thermoplastic polyurethane (TPU) or rubberized TPU molds at the top outsole. Thus, the contoured thin sole 1202, can provide increased comfort and performance compared to conventional golf shoe soles having a single rigid platform that spans the sole and supports the traction elements in a dependent manner. The poured midsole can provide a durable yet soft and comfortable region below the golfer's foot and can bond directly to the injection molded outsole without cement or other rigid adhesion materials. Additionally, the contoured thin sole 1202 described herein can be lighter than conventional soles due to the use of lightweight polymeric materials, direct bonding of the constituent materials without cement, lack of other conventional platform components, and other properties.

Although various embodiments described above, disclose the use of Boost™ foam material for the midsole and rubberized TPU or TPU for the outsole material, other embodiments of the invention are not limited to using a particular type of material for the midsole or the outsole. In various embodiments, the midsole and/or outsole can each be made from any other suitable material(s) depending on a particular application and/or desired characteristics, such as a polymer, rubber, EVA, etc., or any combination of such materials.

While various embodiments of the invention have been described above, it should be understood that they have been presented by way of example only, and not by way of limitation. Likewise, the various figures or diagrams presented depict an example design, structure or configuration, which is done to aid in understanding the concepts, features and functionality that can be included in various shoe pairs in accordance with one or more embodiments of the invention. The invention is not restricted to the illustrated exemplary designs, structures or configurations, but can be implemented using a variety of alternative designs, structures and configurations depending on the particular sporting activity (e.g., golf, baseball, track and field, etc.) or performance characteristics desired for a particular application.

Additionally, it should be understood that the various features and functionality described in one or more of the individual embodiments are not limited in their applicability to the particular embodiment with which they are described, but instead can be applied, alone or in some combination, to one or more of the other embodiments of the invention, whether or not such embodiments are explicitly described and whether or not such features are presented as being a part of a particular described embodiment. Thus, the breadth and scope of the present invention should not be limited by any of the above-described exemplary embodiments but should be accorded a scope commensurate with the claims presented herein.

What is claimed is:

1. A sole of a shoe, comprising:

a rear portion;

a forward portion connected with the rear portion, the forward portion being thinner than the rear portion, the forward portion comprising a plurality of ribs, wherein the plurality of ribs are arranged in a pattern, wherein each of the ribs comprises a size and a shape, wherein the plurality of ribs are separated from one another by spaces that define at least one distinct area in a shape of an ellipse that is configured to correspond to an area where at least one portion of a wearer's foot will be closest to the ground during a sporting activity, and wherein the size of the ribs, the shape of the ribs, and the pattern of the ribs are collectively configured to provide the forward portion of the sole of the shoe with at least one of a height characteristic, a rigidity characteristic, and a flexibility characteristic; and a ground contacting surface disposed on a bottom surface of the sole of the shoe, opposite the plurality of ribs.

2. The sole of claim 1, wherein the plurality of ribs extend in a direction of travel between a lateral side and a medial side of the sole.

3. The sole of claim 1, wherein the at least one distinct area comprises a section selected from the group consisting of a big toe section, a lateral pad section, and a big toe pad section.

4. The sole of claim 1, further comprising:

an outsole having a plurality of traction elements extending outwardly from a bottom surface of the outsole, wherein the plurality of ribs extend upwardly from a top surface of the outsole to form the forward portion.

5. The sole of claim 4, wherein the rear portion comprises:

a cushioning structure formed on the top surface of the outsole, wherein the cushioning structure is made from a different material than the plurality of ribs and rises above the top surface of the outsole a greater distance than each of the plurality of ribs.

6. The sole of claim 5 wherein the plurality of ribs are made from a first polymer material and the cushioning structure is made from an expanded thermoplastic polyurethane (TPU) material.

7. The sole of claim 1, wherein the plurality of ribs become thinner as they approach a point across a longitudinal central axis and below a portion of the sole of the shoe configured to correspond to a transition between metatarsal bones and phalange bones of an overlying foot of a wearer may rest.

8. A shoe, comprising an upper; and a sole attached to the upper, the sole comprising:

a rear portion, the rear portion comprising a cushioning structure; and a forward portion connected with the rear portion, the forward portion comprising a plurality of ribs, wherein a portion of the plurality of the ribs are discontinuous in a lateral to medial direction such that a space is formed in each of the discontinuous ribs in the lateral to medial direction, wherein the spaces in the discontinuous ribs are configured to form a distinct area in the plurality of ribs that corresponds to at least one of a height characteristic, a rigidity characteristic, and a flexibility characteristic, and wherein the distinct area is configured to correspond to an area where at least one portion of a wearer's foot will be closest to the ground during a sporting activity and wherein a first rib is disposed in the distinct area and a second rib is disposed outside of the distinct area; and a ground contacting surface disposed on a bottom surface of the sole, opposite the plurality of ribs.

9. The shoe of claim 8, wherein the cushioning structure is made from a different material than the plurality of ribs and rises above a top surface of the sole a greater distance than each of the plurality of ribs.

10. The shoe of claim 8, wherein the plurality of ribs are made from a first polymer material and the cushioning structure is made from a rubberized thermoplastic polyurethane (TPU) material.

11. The shoe of claim 8, wherein the cushioning structure is made from a granular thermoplastic polyurethane (TPU) foam material.

12. The shoe of claim 8, wherein the at least one distinct area is in a shape of an ellipse.

13. The shoe of claim 8, wherein the at least one distinct area comprises a section selected from the group consisting of a big toe section, a lateral pad section, and a big toe pad section.

14. The shoe of claim 13, wherein the big toe section is configured to receive a big toe of a foot, the lateral pad section is configured to receive a lateral pad of the foot, and the big toe pad section is configured to receive a big toe pad of the foot.

15. The shoe of claim 13, wherein the at least one distinct area is thinner than another part of the forward portion.

16. The shoe of claim 13, wherein at least one distinct area comprises sectional ribs thinner than other ribs of the plurality of ribs.

17. A golf shoe, comprising an upper;

a sole attached to the upper, the sole comprising:

a rear portion, the rear portion comprising a cushioning structure; and a forward portion connected with the rear portion, the forward portion being thinner than the rear portion, the forward portion comprising a plurality of ribs separated from one another by spaces that define at least one distinct area configured to correspond to where at least one portion of a wearer's foot will be closest to the ground during a golf swing, wherein at least one of the ribs defining the distinct area does not extend in a continuous line in a lateral to medial direction so as to define the space that defines the distinct area, wherein the at least one distinct area comprises a section selected from the group consisting of a big toe section, a lateral pad section, and a big toe pad section, wherein at least one distinct area comprises a first spacing among the plurality of ribs that substantially circumscribes at least one distinct area, and wherein the at least one distinct area comprises second spacing among the plurality of ribs, the second spacing substantially concentric with the first spacing; and a ground contacting surface disposed on a bottom surface of the sole of the shoe, opposite the plurality of ribs.

18. The golf shoe of claim 17, wherein the at least one distinct area is in a shape of an ellipse.

19. The golf shoe of claim 17, wherein the big toe section is configured to receive a big toe of a foot, the lateral pad section is configured to receive a lateral pad of the foot, and the big toe pad section is configured to receive a big toe pad of the foot.

20. The golf shoe of claim 17, wherein the at least one distinct area is thinner than another part of the forward portion.

21. The golf shoe of claim 17, wherein the at least one distinct area comprises sectional ribs thinner than other ribs of the plurality of ribs.

22. The golf shoe of claim 17, wherein the second spacing is within an area substantially surrounded by the first spacing.

23. The golf shoe of claim 17, wherein the second spacing is outside of an area substantially surrounded by the first spacing.

24. The golf shoe of claim 17, wherein a first density of the plurality of ribs within the at least one distinct area is less than a second density of the plurality of ribs in another part of the forward portion.

25. The golf shoe of claim 17, wherein the at least one distinct area is one of a plurality of distinct areas, and wherein the plurality of distinct areas comprises the big toe section, the lateral pad section, and the big toe pad section.

* * * * *